US011959040B2

(12) United States Patent
Soto et al.

(10) Patent No.: US 11,959,040 B2
(45) Date of Patent: Apr. 16, 2024

(54) SOLVENCY ENHANCER COMPOSITIONS, METHODS OF PREPARATION AND METHODS OF USE THEREOF

(71) Applicant: Fluitec N.V., Brussels (BE)

(72) Inventors: Cristian A. Soto, Jersey City, NJ (US); Jatin N. Mehta, Jersey City, NJ (US); Greg Livingstone, Tucson, AZ (US); Wade Flemming, Wichita, KS (US); John Sander, Wichita, KS (US)

(73) Assignee: Fluitec N.V., Brussels (BE)

( * ) Notice: Subject to any disclaimer, the term of this patent is extended or adjusted under 35 U.S.C. 154(b) by 0 days.

(21) Appl. No.: 17/595,900

(22) PCT Filed: May 29, 2020

(86) PCT No.: PCT/US2020/035245
§ 371 (c)(1),
(2) Date: Nov. 29, 2021

(87) PCT Pub. No.: WO2020/243515
PCT Pub. Date: Dec. 3, 2020

(65) Prior Publication Data

US 2022/0243141 A1 Aug. 4, 2022

Related U.S. Application Data

(60) Provisional application No. 62/854,847, filed on May 30, 2019.

(51) Int. Cl.
*C10M 111/02* (2006.01)
*C10N 30/04* (2006.01)
(Continued)

(52) U.S. Cl.
CPC ..... *C10M 111/02* (2013.01); *C10M 2203/003* (2013.01); *C10M 2207/021* (2013.01);
(Continued)

(58) Field of Classification Search
CPC ..... C10M 111/02; C10M 2203/003; C10M 2207/021; C10M 2207/282;
(Continued)

(56) References Cited

U.S. PATENT DOCUMENTS 3,676,348 A 7/1972 Unick
5,360,560 A 11/1994 Schmid
(Continued)

FOREIGN PATENT DOCUMENTS

CN 107523388 A 12/2017
EP 3152280 A1 12/2015
(Continued)

OTHER PUBLICATIONS

Sasol, Isofol 2426S Product Brochure, retrieved from the internet at < https://www.sasolguerbet.com/fileadmin/sasolguerbet/0364.SAS-Folder_Isofol_2426S_WEB.pdf> on Jan. 30, 2023 (Year: 2016).*
(Continued)

*Primary Examiner* — James C Goloboy
(74) *Attorney, Agent, or Firm* — Stratford Group Ltd.

(57) ABSTRACT

Disclosed are solvency enhancer compositions, for example, as additives to lubricating oils and as formulated in lubricating oil compositions and associated methods of preparation and use thereof. The compositions and methods can dissolve at least one of oxidation products and other organic polar compounds, due to lubricant degradation, formed and suspended in oil compositions including adding an effective amount of a solvency enhancer to the oils, wherein the solvency enhancer includes Guerbet alcohols. Further described are methods for dissolving organic deposits in an oil system including adding an effective amount of a solvency enhancer to the oil system, wherein the solvency enhancer includes Guerbet alcohols. Also provided are methods for preventing sludge and varnish formation in
(Continued)

in-service oils including adding an effective amount of a solvency enhancer to the oils, wherein the solvency enhancer includes Guerbet alcohols.

25 Claims, 4 Drawing Sheets

(51) Int. Cl.

| | |
|---|---|
| ***C10N 30/10*** | (2006.01) |
| ***C10N 40/00*** | (2006.01) |
| ***C10N 40/04*** | (2006.01) |
| ***C10N 40/08*** | (2006.01) |
| ***C10N 40/12*** | (2006.01) |
| ***C10N 40/30*** | (2006.01) |

(52) U.S. Cl.
CPC ... *C10M 2207/282* (2013.01); *C10N 2030/04* (2013.01); *C10N 2030/10* (2013.01); *C10N 2040/04* (2013.01); *C10N 2040/08* (2013.01); *C10N 2040/12* (2013.01); *C10N 2040/135* (2020.05); *C10N 2040/30* (2013.01)

(58) Field of Classification Search
CPC ..... C10N 2030/04; C10N 2030/10; C10N 2040/04; C10N 2040/08; C10N 2040/12; C10N 2040/135; C10N 2040/30
See application file for complete search history.

(56) References Cited

U.S. PATENT DOCUMENTS

| | | | | |
|---|---|---|---|---|
| 5,578,558 | A | 11/1996 | Mueller et al. | |
| 8,299,002 | B2 * | 10/2012 | Glasgow ..... | C10M 161/00 508/459 |
| 2012/0202723 | A1 | 8/2012 | Abbey et al. | |
| 2015/0099678 | A1 | 4/2015 | Abi-Karam | |
| 2015/0203740 | A1 | 7/2015 | Shong | |
| 2017/0044424 | A1 | 2/2017 | Dwarakanath et al. | |
| 2017/0137738 | A1 * | 5/2017 | Hobson ..... | C10M 169/04 |
| 2020/0299603 | A1 | 9/2020 | Champagne | |

FOREIGN PATENT DOCUMENTS

| | | | |
|---|---|---|---|
| WO | 2015191890 | A1 | 12/2015 |
| WO | 2018210829 | A1 | 11/2018 |

OTHER PUBLICATIONS

Modern Daily Chemical Products, Duoren Wang, p. 259, Metallurgical Industry Press.
International Search Report and Written Opinion for PCT/US2020/035245 dated Aug. 27, 2020, 10 pages.
Boddien et al., "Isofol Esters—Branched Guerbet Esters", IP.com, IP.com, inc., Apr. 1, 2015, 17 pages.
Extended European Search Report for International Application No. PCT/US2020/035245, dated May 11, 2023, 13 pages.
Kuhn "Isofol Esters—Branched Guerbet Esters", ip.com, ip.com Inc., West Henriette, NY, U.S., Apr. 1, 2015, XP013166995, ISSN: 1544-0001.
Sasol, "Isofol 2426S Sasol Performance Chemicals", pp. 1-6, XP093042839, https://www.sasolguerbet.com/fileadmin/sasolguerbet/0364.SAS-Folder_Isofo1_2426S_WEB.pdf.
Extended European Search Report for corresponding EP Application No. 20815015.1, dated May 31, 2023.

* cited by examiner

SOLVENCY ENHANCER COMPOSITIONS, METHODS OF PREPARATION AND METHODS OF USE THEREOF

CROSS-REFERENCE TO RELATED APPLICATION(S)

The present application is a national stage entry under 35 U.S.C. § 371 of International Application No. PCT/US2020/035245, filed on May 29, 2020, which claims priority to U.S. Provisional Patent Application No. 62/854,847, filed on May 30, 2019, the contents of which are hereby incorporated by reference in their entirety.

FIELD

Disclosed herein are solvency enhancer compositions, for example, as additives for a lubricating oil composition and/or as formulated with a lubricating oil to dissolve byproducts and prevent sludge and varnish within the lubricating oil and/or operating equipment. Further disclosed are methods of preparation of such compositions and methods of use thereof.

BACKGROUND

Rotating equipment lubricating oils and hydraulic oils must meet a number of requirements, for example, pour point (D97). Addition of tank side additives into the oils is sometimes required to preserve or enhance these properties. Typically, these additives are referred to as co-solubilizers or solubilizers and assist in dissolving additive components within a base oil, based on the principle of "like-dissolves-like." Co-solubilizers are used in non-polar bases such as API Group II, III or IV base oils.

Deposits arise from the degradation of oil additives, co-solubilizers and/or base oils. Degradation of lubricating and hydraulic oils/fluids (referred to hereinafter as "working fluids") occurs during their service through a variety of mechanisms. These mechanisms may vary and include oxidation, thermal degradation, and hydrolysis among others. These degradation processes can result in the formation of varnish/sludge/deposits (referred to herein as "deposits") causing compounds. These degradation products, with increasing concentrations, become insoluble in the lubricants and decant from the solutions onto metal surfaces of the lubricating systems and on critical machine components.

Polyhydroxyl functional compounds that contain an all hydrocarbon backbone can be used as additives in hydrocarbon oils, drilling fluids, industrial and automotive lubricating fluids, dispersants, engine lubricants, greases, coatings, adhesives. A lubricating composition containing an oil of lubricating viscosity, 1 to 1000 parts per million by weight of titanium in the form of an oil-soluble titanium-containing material, and at least one additional lubricant additive provides beneficial effects on properties such as deposit control, oxidation, and filterability in engine oils. However, there is a need for solvency enhancers that control deposit formation in lubricating or hydraulic oils and/or solubilize the pre-formed deposits, e.g., varnish in working turbine oil lubricating systems.

BRIEF SUMMARY

According to embodiments, disclosed herein are methods for dissolving oxidation products and/or other organic degradation compounds formed and suspended or dissolved in oils comprising adding an effective amount of a solvency enhancer as a tank side additive to the oils, wherein the solvency enhancer comprises at least one Guerbet alcohol. Optionally, the oxidation products comprise antioxidant degradation compounds and oil-derived degradation compounds.

In some embodiments, the oils comprise lubricating oils, heat transfer fluids or hydraulic oils. Optionally, the lubricating oils are selected from a group consisting of turbine oils, compressor oils, paper machine oils, refrigerant oils and gear oils. Optionally, the hydraulic oils are non-aqueous mineral and/or synthetic oils. Optionally, the oils comprise mineral formulations, synthetic formulations or a combination thereof.

In some embodiments, the at least one Guerbet alcohol has about 12 to about 32 carbon atoms (in total). Optionally, the at least one Guerbet alcohol has about 24 carbon atoms. Optionally, the at least one Guerbet alcohol has a Noack volatility (ASTM D5800) at a level of from 10% to 18% of the oils. Optionally, the at least one Guerbet alcohol has Hansen factors comprising a dispersion (D) parameter of from 15 to 18, a polar (P) parameter of from 3.5 to 5.5, and a hydrogen bonding (H) parameter of from 8 to 12. Optionally, the at least one Guerbet alcohol has interfacial surface energies of from 25 mN/m to 35 mN/m. Optionally, the at least one Guerbet alcohol has an aniline (ASTM D611) point of from 7° C. to 37° C.

In some embodiments, the oils, prior to the addition of the solvency enhancer, comprise an API Group I base oil, a Group II base oil, a Group III base oil, a Group IV base oil, a Group V base oil or a combination thereof. Optionally, the solvency enhancer comprises the Guerbet alcohol at an amount of 50%-80%, adipate ester at an amount of 1%-10% and a base oil at an amount of 10%-50% by weight relative to the total weight of the solvency enhancer, wherein the base oil comprises an API Group I base oil, a Group II base oil or a combination thereof. Optionally, the working mixture is in service for a period of 1 month to 12 months after the addition of the solvency enhancer. Optionally, the oils are in service within a mechanical system at a temperature of about −50° C. to about 230° C., or about −50° C. to about 50° C., or about 10° C. to about 80° C., or about 10° C. to about 120° C. or about 25° C. to about 230° C., or about −50 to about 120° C., or about 25° C. to about 230° C.

In some embodiments, the method further comprises forming a working mixture. Optionally, the working mixture comprises lubricant oils, degradation byproducts, the solvency enhancer, and the solvency enhancer degradation byproducts. Optionally, the at least one Guerbet alcohol in the working mixture is present in an amount of about 1.0% to 30% by volume relative to the total volume of the working mixture. Optionally, the working mixture has a lower ΔE value measured by a color spectrometer than the oils prior to the addition of the solvency enhancer. Optionally, the color spectrometer is used for Membrane Patch Colorimetry (MPC) (ASTM D7843).

Further disclosed herein are methods for dissolving organic deposits in a system comprising an oil composition, the method comprising adding an effective amount of a solvency enhancer as a tank side additive to the oil composition within the system, wherein the solvency enhancer comprises the at least one Guerbet alcohol. Optionally, the organic deposits comprise agglomerated degradation byproducts of base oils, antioxidants, or other additives, wherein the other additives comprise defoamants and co-solubilizers.

In some embodiments, the oil system comprises lubricating oils, heat transfer oils, or hydraulic oils. Optionally, the lubricating oils are selected from a group consisting of turbine oils, gear oils, compressor oils paper machine oils, and refrigerant oils. Optionally, the hydraulic oils are non-aqueous mineral and synthetic oils. Optionally, the oils comprise mineral formulations, synthetic formulations or a combination thereof. Optionally, the oils comprise an API Group I base oil, a Group II base oil, a Group III base oil, a Group IV base oil, a Group V base oil or a combination thereof, prior to the addition of the solvency enhancer. Optionally, the working mixtures (in service oils plus solvency enhancers) are in service for less than 6 months. Optionally, the oils are in service within a mechanical system at a temperature of about −50° C. to about 230° C., or about −50° C. to about 50° C., or about 10° C. to about 80° C., or about 10° C. to about 120° C. or about 25° C. to about 230° C.

In some embodiments, the at least one Guerbet alcohol is added to the oil system have a size of from about 12 to about 32 carbon atoms. Optionally, the at least one Guerbet alcohol has a size of about 18 to about 24 carbon atoms. Optionally, the at least one Guerbet alcohol has a Noack volatility (ASTM D5800) at a level of from 10% to 72% of the oils. Optionally, the at least one Guerbet alcohol has Hansen factors comprising a dispersion (D) parameter of from 15 to 18, a polar (P) parameter of from 3.5 to 6.5, and a hydrogen bonding (H) parameter of from 8 to 13. Optionally, the at least one Guerbet alcohol has interfacial surface energies of from 15 mN/m to 45 mN/m. Optionally, the at least one Guerbet alcohol has an aniline point of from −10° C. to 37° C. Optionally, the at least one Guerbet alcohol is present in an amount of 0.1% to 30%, 0.3% to 25%, or 0.5% to 20% by volume relative to the total volume of the working mixture.

In some embodiments, the solvency enhancer comprise the at least one Guerbet alcohol in an amount of 50%-80%, adipate ester at an amount of 1%-10% and a base oil at an amount of 10% to 50%, wherein the base oil comprises an API Group I base oil, a Group II base oil, or a combination thereof. Optionally, the in-service oils are added with the solvency enhancer to solubilize degradation derived organic deposits.

In some embodiments, comprising forming a working mixture, wherein the working mixture comprises newly solubilized species from the organic deposits. Optionally, the working mixture clean solid surfaces by solubilizing organic deposits. Optionally, the working mixture has a lower ΔE value measured by a color spectrometer than the oils prior to the addition of the solvency enhancer. Optionally, the color spectrometer is used for Membrane Patch Colorimetry (MPC) (ASTM D7843).

Further disclosed herein are methods for preventing sludge and varnish formation in in-service oils comprising adding an effective amount of a solvency enhancer to the oils, wherein the solvency enhancer comprises Guerbet alcohols.

In some embodiments, the oils comprise lubricating oils, heat transfer oils, or hydraulic oils. Optionally, the lubricating oils are selected from a group consisting of turbine oils, gear oils, compressor oils, and refrigerant oils. Optionally, the hydraulic oils are non-aqueous mineral and synthetic oils. Optionally, the oils comprise mineral formulations, synthetic formulations or a combination thereof. Optionally, the oils comprise an API Group I base oil, a Group II base oil, a Group III base oil, a Group IV base oil, a Group V base oil or a combination thereof.

In some embodiments, the at least one Guerbet alcohol has a size of $C_{12}$-$C_{32}$. Optionally, the at least one Guerbet alcohol is in the form of $C_{24}$. Optionally, the at least one Guerbet alcohol has a Noack volatility (ASTM D5800) level of 10%-18% of the oils. Optionally, the at least one Guerbet alcohol has Hansen factors comprising a dispersion (D) parameter of from 15 to 18, a polar (P) parameter of from 3.5 to 5.5, and a hydrogen bonding (H) parameter of from 8 to 12. Optionally, the at least one Guerbet alcohol has interfacial surface energies of 25 mN/m-35 mN/m. Optionally, the at least one Guerbet alcohol has an aniline point of 7° C.-37° C.

In some embodiments, the solvency enhancer comprises the Guerbet alcohols at an amount of 40-100%, adipate ester at an amount of 0-5% and a base oil at an amount of 0-50% by weight relative to the total weight of the solvency enhancer, wherein the base oil is selected from a group consisting of an API Group I base oil, a Group II base oil or a combination thereof. Optionally, the oils are in service within a mechanical system at a temperature of −50° C. to 120° C. Optionally, the working mixture is used for a period greater than 1 year after the addition of the solvency enhancer. In some embodiments, the compositions and methods described herein are compatible with the subsequent addition or co-addition of other additives such as antioxidants, extreme pressure agents, antiwear agents and defoamants.

In some embodiments, the method further comprises forming a working mixture. Optionally, the working mixture comprises lubricant oils, degradation byproducts, the solvency enhancer, and the solvency enhancer degradation byproducts. Optionally, the at least one Guerbet alcohol in the working mixture is present in an amount of about 1.0% to about 30% by volume relative to the total volume of the working mixture, or greater than 1.0% to about 30% by volume relative to the total volume of the mixture. Optionally, the working mixture has a lower ΔE value by a color spectrometer than the in-service oil prior to the addition of the solvency enhancer. Optionally, the color spectrometer is used for Membrane Patch Colorimetry (MPC) (ASTM D7843).

BRIEF DESCRIPTIONS OF THE DRAWINGS

DETAILED DESCRIPTION

Figure 1A:
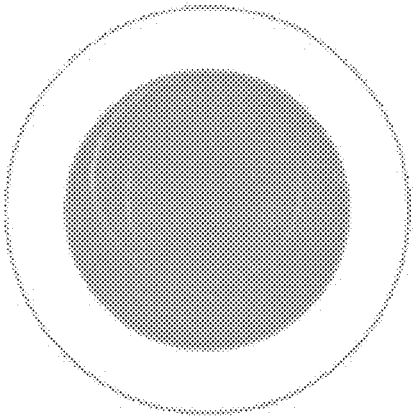
FIG. 1A depicts and in-service oil before treatment with a Guerbet alcohol.

The description and specific examples, while indicating embodiments of the invention, are intended for purposes of illustration only and are not intended to limit the scope of the invention. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this invention and, unless explicitly stated otherwise, are not intended to be a representation that given embodiments of this invention have, or have not, been made or tested.

Lubricants can oxidize over time, which results in the formation of byproducts within the lubricant. The byproducts may become insoluble and can deposit as varnish on metal components within the equipment through which the lubricant circulates. The compositions and methods disclosed herein utilize one or more Guerbet alcohol as an additive to a lubricant composition (e.g., as a solubility enhancer, as a component of the working lubricant composition, etc.) and/or as a cleaning agent that solubilize precipitates and varnish formed within the system. As a lubricant composition containing a solvency enhancer according to embodiments herein ages, it becomes oxidatively stressed over time. Solvency enhancers as described herein are able to maintain all degradation byproducts in solution.

In embodiments, the one or more Guerbet alcohol may be added to an about 50 gal to about 5,000 gal reservoir of a lubricant composition. Adding the one or more Guerbet alcohol solubilizes any byproducts/material that has formed and/or precipitated from the composition. It has been found that the one or more Guerbet alcohol has a surprisingly long lifetime within the lubricant composition. Known solubilizers can work initially, but thereafter degrade causing byproducts of their own that can impact the performance of the lubricant composition. Contrary to other known solubilizers, the one or more Guerbet alcohol, according to embodiments herein, can improve the fluid properties of the lubricant composition and has a longer lifetime, even at high temperatures, than other known solubilizers.

In embodiments, the one or more Guerbet alcohol can be added to a lubricant composition as a cleaning agent. After a particular period of time circulating through the equipment and/or until the byproducts and any varnish have been solubilized, then the lubricant composition containing the one or more Guerbet alcohol may be drained from the system and fresh lubricant, with or without the one or more Guerbet alcohol can be added.

In yet further embodiments, a lubricant composition may be formulated with one or more Guerbet alcohol, and optionally with other additives, and the complete mixture added to the equipment. If the lubricant composition from the outset contains the one or more Guerbet alcohol, then precipitates may not form at all and/or varnish may not adhere to the mechanical components within the system. Formulating lubricant compositions with the one or more Guerbet alcohol can extend the life of the composition as compared to the composition without the one or more Guerbet alcohol.

According to various embodiments, blends of Guerbet alcohols used. For example, short chain (e.g., about 1 to about 18 carbon atoms) Guerbet alcohols can more quickly dissolve byproducts than long chain (e.g., about 18 to about 32 carbon atoms) Guerbet alcohols. As will be described in more detail below, there are also embodiments comprising a blend of Guerbet alcohols suitable for low to slightly elevated temperature (e.g., −50° C. to 120° C.) applications. Another blend of Guerbet alcohols may be suitable for ambient to elevated temperature (e.g., ambient to about 230° C.) applications, for example, long chain Guerbet alcohols that are less likely to evaporate at elevated temperatures.

According to various embodiments, selection of a solvency enhancer containing one or more Guerbet alcohols having an appropriate carbon length and desired properties, ensures that the solvency enhancer itself does not contribute to deposit formation as the mixture is oxidized during the lubricant operations. Methods as described herein can extend the operational life of the mechanical systems being lubricated by maintaining operational temperatures within specifications, which allows the mechanical system to operate without unplanned or planned stoppages.

Definitions

"American Petroleum Institute (API) base oils," as referred to herein, are defined in accordance with the American Petroleum Institute (API) Base Oil Interchangeability Guidelines. API base oils include five groups: Group I, II, and III base oils are derived from crude oil (mineral oil); Group IV base oil is a fully synthetic oil; and Group V base oil is for all base oils that are not included in one of the other groups. Group I base oils have sulfur content>0.03 percent by weight, and/or <90 percent by weight saturates, and viscosity index 80-120. Group II base oils have sulfur content≤0.03 percent by weight, and/or ≥90 percent by weight saturates, viscosity index 80-120. Group III base oils have sulfur content≤0.03 percent by weight and ≥90 percent by weight saturates, viscosity index≥120. Group IV base oils have all polyalphaolefins (PAO) such as PAO-2, PAO-4, PAO-5, PAO-6, PAO-7 or PAO-8. Group V base oils encompass "all others" which do not fall within any of Groups I-IV.

"Tank side additives" as used herein refer to additives that can be added to an in-service fluid reservoir without the necessity of specialized mixing equipment or blending tanks.

"Hansen solubility parameters," as used herein, refer to parameters that were developed by Charles M. Hansen as a way of predicting if one material will dissolve in another and form a solution. These parameters are based on the idea that "like dissolves like" where one molecule is defined as being "like" another if it bonds to itself in a similar way. Specifically, each molecule is given three Hansen parameters, each generally measured in $MPa^{1/2}$: 1) the energy from dispersion forces between molecules; 2) the energy from dipolar intermolecular force between molecules; and 3) the energy from hydrogen bonds between molecules.

"Lubricating oil" as used herein refers to a complex mixture containing linear and branched paraffins, cyclic alkanes and aromatic hydrocarbons ($>C_{15}$ with boiling points between 300° C. and 600° C.) (Vazquez-Duhalt, 1989).

"Hydraulic fluids," as used herein, refer to the medium by which power is transferred in hydraulic machinery. Common hydraulic fluids are based on mineral oil or water. Examples of equipment that might use hydraulic fluids are excavators and backhoes, hydraulic brakes, power steering systems, transmissions, garbage trucks, aircraft flight control systems, lifts, and industrial machinery.

"Membrane Patch Colorimetry (MPC)" is a measure of the potential for varnish formation by measuring insoluble colored bodies in lubricating oils. The method measures the CIELAB ΔE value using a color surface spectrometer. Higher values of ΔE indicate a higher potential for deposit (varnish) formation.

Guerbet alcohols as disclosed herein refer to alcohols made via a Guerbet reaction, which was named after Marcel Guerbet. In a Guerbet reaction, a primary aliphatic alcohol is converted to its alkylated dimer alcohol (i.e., a branched, primary, saturated alcohol). Examples of Guerbet alcohols are shown in formula (I) (C=20), formula (II) (C=25) or formula (III) (C=16):

(I)

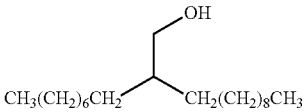

(II)

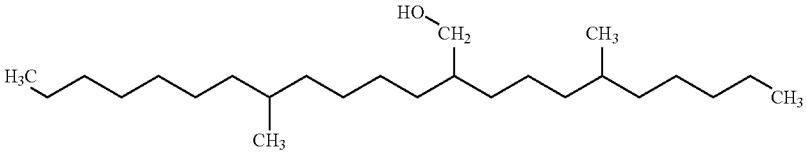

(III)

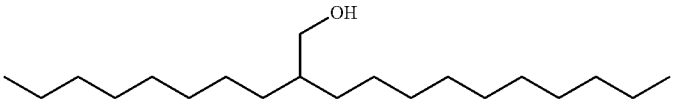

"Oxidation products" refer to byproducts from oils or additives (e.g., antioxidants) such as aldehydes, fatty acids, and peroxides among others. These oxidative products can further react to form high molecular weight polymeric species and macromolecules that form deposits on solid surfaces in contact with the fluid.

"Other additives" as used herein refers to components other than a Guerbet alcohol that are added to oils. Examples of "other additives" include a demulsifier, a dispersant, a metal deactivator, a foam inhibitor, a pour point depressant, an antioxidant, an antiwear agent, an extreme pressure agent and a viscosity modifier.

Reference throughout this specification to one embodiment, certain embodiments, one or more embodiments or an embodiment means that a particular feature, structure, material, or characteristic described in connection with the embodiment is included in at least one embodiment of the invention. Thus, the appearances of the phrases such as in one or more embodiments, in certain embodiments, in one embodiment or in an embodiment in various places throughout this specification are not necessarily referring to the same embodiment of the invention. Furthermore, the particular features, structures, materials, or characteristics may be combined in any suitable manner in one or more embodiments.

As used herein, the singular forms a, an, and the include plural references unless the context clearly indicates otherwise. Thus, for example, reference to a catalyst material includes a single catalyst material as well as a mixture of two or more different catalyst materials.

As used herein, the term about in connection with a measured quantity, refers to the normal variations in that measured quantity as expected by one of ordinary skill in the art in making the measurement and exercising a level of care commensurate with the objective of measurement and the precision of the measuring equipment. In certain embodiments, the term about includes the recited number ±10%, such that about 10 would include from 9 to 11.

The term at least about in connection with a measured quantity refers to the normal variations in the measured quantity, as expected by one of ordinary skill in the art in making the measurement and exercising a level of care commensurate with the objective of measurement and precisions of the measuring equipment and any quantities higher than that. In certain embodiments, the term at least about includes the recited number minus 10% and any quantity that is higher such that at least about 10 would include 9 and anything greater than 9. This term can also be expressed as about 10 or more. Similarly, the term less than about typically includes the recited number plus 10% and any quantity that is lower such that less than about 10 would include 11 and anything less than 11. This term can also be expressed as about 10 or less.

Unless otherwise indicated, all parts and percentages are by weight. Weight percent (wt %), if not otherwise indicated, is based on the entire composition. Volume percent (vol %), if not otherwise indicated, is based on the total volume of the composition.

Compositions and Methods

Disclosed herein are compositions and methods for dissolving oxidation products and other organic polar compounds that form in lubricant oil compositions as a result of lubricant degradation. These compounds become suspended in the compositions. According to embodiments, an effective amount of a solvency enhancer is added to the lubricant oil composition to dissolve byproducts and/or prevent the formation of sludge and varnish. In embodiments, the solvency enhancer comprises at least one Guerbet alcohol. Methods and compositions as described herein also provide operational benefits that include better temperature control and extension of the operational range of industrial equipment.

Also disclosed herein are methods for dissolving organic deposits in system comprising an oil composition, the method comprising adding an effective amount of a solvency enhancer, according to embodiments herein, to the oil composition. In embodiments, the solvency enhancer contains at least one Guerbet alcohol.

Further disclosed herein are methods for preventing sludge and varnish formation in oil compositions (e.g., in-service oils) including adding an effective amount of a solvency enhancer to the oil compositions, wherein the solvency enhancer includes at least one Guerbet alcohol. The methods and compositions presented also provide operational benefits that include better temperature control and extension of the operational range of industrial equipment.

In embodiments, the present disclosure provides a method for dissolving oxidation products formed, dissolved and/or suspended in an oil composition. In embodiments, the oxidation products include antioxidant degradation compounds and oil-derived degradation compounds.

The oil composition can include lubricating oils, heat transfer fluids, hydraulic oils, mineral formulations, synthetic formulations or combinations thereof. According to embodiments, the lubricating oils can include turbine oils, refrigerant oils, gear oils and combinations thereof. The hydraulic oils can include non-aqueous mineral and/or synthetic oils. Hydraulic oils are used in excavators and backhoes, hydraulic brakes, power steering systems, transmissions, garbage trucks, aircraft flight control systems, lifts, plastic injection molding machines, metal hydraulic presses, controllable pith propellers and industrial machinery. As such, solvency enhancers including hydraulic oils as disclosed herein are suitable for use in such applications. According to embodiments, the heat transfer fluids can include coolants, nanofluids, heat transfer oils and combinations thereof. According to various embodiments, the oil composition, prior to the addition of a solvency enhancer as described herein, includes an API Group I base oil, a Group II base oil, a Group III base oil, a Group IV base oil, a Group V base oil or combinations thereof.

The method can include adding an effective amount of a solvency enhancer as described herein as a tank side additive to the oils. In embodiments, the solvency enhancer includes at least one Guerbet alcohol. The at least one Guerbet alcohol can have about 12 to about 32 carbon atoms, or about 12 to about 18 carbon atoms, or about 18 to about 30 carbon atoms, or about 18 to about 24 carbon atoms. In embodiments, the at least one Guerbet alcohol has about 18 to about 24 carbon atoms. In embodiments, the at least one Guerbet alcohol can have one or more of formulas (I) to (III). According to embodiments, suitable solvency enhancer formulations are shown in Tables 1 and 2.

TABLE 1

Solvency Enhancer Composition

| Chemical(s) | Vol. % based on Total Volume | Chemical Formula |
|---|---|---|
| 16-Methylheptadecanol ((Isostearyl alcohol)) (C18) | 20-50% | 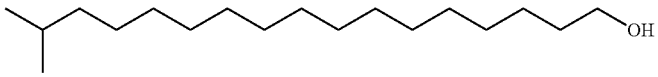 |
| Alcohols, C12-13-branched and linear, dimerized (C24-C26). mixture | 30-70% | 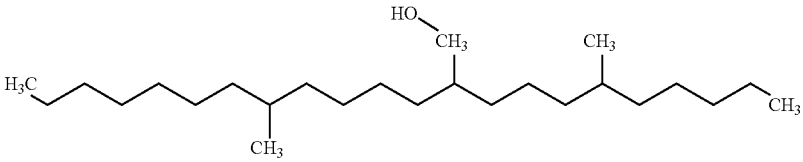 |

TABLE 2

Solvency Enhancer Formulation

| Chemical(s) | Vol. % based on Total Volume | Chemical Formula |
|---|---|---|
| 16-Methylheptadecanol ((Isostearyl alcohol)) (C18) | 20-50% | 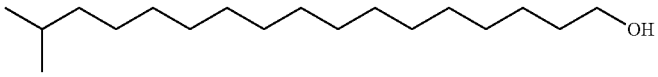 |
| 2-octyldodecanol (C20) | 30-70% | 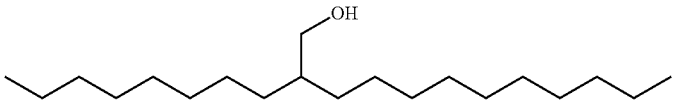 |

The at least one Guerbet alcohol can have a Noack volatility (as measured using ASTM D5800) at a level of about 5 wt % to about 30 wt %, or about 8 wt % to about 25 wt %, or about 10 wt % to about 18 wt % of the total oil composition. In embodiments, the at least one Guerbet alcohol can have Hansen solubility parameters including a dispersion (D) parameter of about 14 $MPa^{1/2}$ to about 20 $MPa^{1/2}$ or about 15 $MPa^{1/2}$ about 18 $MPa^{1/2}$, a polar (P) parameter of about 3.0 $MPa^{1/2}$ to about 7.0 $MPa^{1/2}$, or about 3.5 $MPa^{1/2}$ to about 6.5 $MPa^{1/2}$, or about 3.5 $MPa^{1/2}$ to about 5.5 $MPa^{1/2}$, about 4.0 $MPa^{1/2}$ to about 5.5 $MPa^{1/2}$ or about 5.0 $MPa^{1/2}$ to about 5.5 $MPa^{1/2}$ and/or a hydrogen bonding (H) parameter of about 7 $MPa^{1/2}$ to about 15 $MPa^{1/2}$, or about 8 $MPa^{1/2}$ to about 14 $MPa^{1/2}$, or about 8 $MPa^{1/2}$ to about 13 $MPa^{1/2}$, or about 8 $MPa^{1/2}$ to about 12 $MPa^{1/2}$, or about 9 $MPa^{1/2}$ to about 12 $MPa^{1/2}$, or about 10 $MPa^{1/2}$ to about 12 $MPa^{1/2}$.

In embodiments, the at least one Guerbet alcohol can have an interfacial surface energy of about 15 mN/m to about 45 mN/m, or about 20 mN/m to about 40 mN/m, or about 25 mN/m to about 35 mN/m. In embodiments, the at least one Guerbet alcohol has an aniline point of about −10° C. to about 40° C., or about −10° C. to about 37° C., or about 5° C. to about 40° C. or about 7° C. to about 37° C. According to embodiments, a solvency enhancer as described herein can include the one or more Guerbet alcohol in an amount of about 30% to about 100%, or about 40% to about 100%, or about 40% to about 80%, or about 50% to about 80%, or about 50% to about 75%, or about 50% to about 70%, or about 55% to about 65%, or 60% to about 62% by weight relative to the total weight of the solvency enhancer.

In further embodiments, the solvency enhancer includes an adipate ester in an amount of about 0% to about 20%, or about 1% to about 15%, or about 1% to about 10%, or about 2 to about 9%, or about 0% to about 5%, or about 3% to about 6% by weight relative to the total weight of the solvency enhancer. A suitable adipate ester can include, but is not limited to, an aliphatic adipate ester having formula (IV) as follows:

(IV)

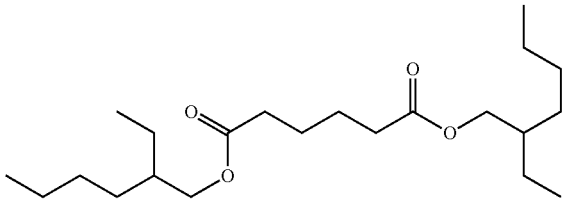

In further embodiments, the solvency enhancer includes a base oil in an amount of about 0% to about 70%, or about 0% to about 60%, or about 5% to about 60%, or about 0% to about 50%, or about 10% to about 50%, or about 15% to about 50%, or about 17% to about 48%, or about 20% to about 45% by weight relative to the total weight of the solvency enhancer. The base oil can include an API Group I base oil, a Group II base oil, or combinations thereof. A suitable base oil can include, but is not limited to a Group I oil (linear, branched, cyclic, naphthenic hydrocarbon) having 14 to 18 carbon atoms and mixtures, for example, as set forth in formula (V):

(V)

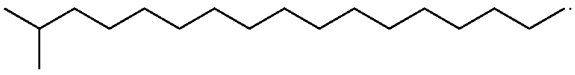

According to embodiments, suitable lubricant formulations including a solvency enhancer, an adipate ester and a base oil are shown in Tables 3 and 4.

TABLE 3

| Lubricant Composition | | |
|---|---|---|
| Chemical(s) | Vol. % based on Total Volume | Chemical Formula |
| Alcohols, C12-13-branched and linear, dimerized (C24-C26). Mixture | 40-70% | 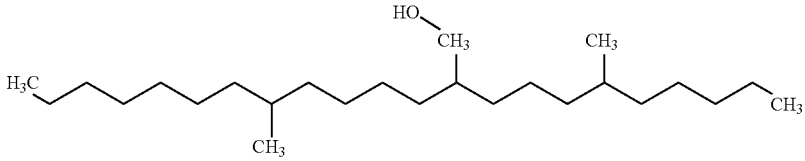 |
| Group I oil (linear, branched, cyclic, naphthenic hydrocarbon) (C14-C18) mixtures | 30-50% | 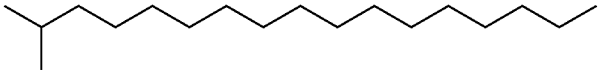 |
| Aliphatic adipate ester | 0-5% | 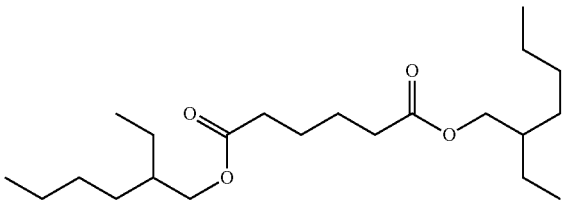 |

TABLE 4

| Lubricant Composition | | |
|---|---|---|
| Chemical(s) | Vol. % based on Total Volume | Chemical Formula |
| 2-octyldodecanol (C20) | 40-70% | 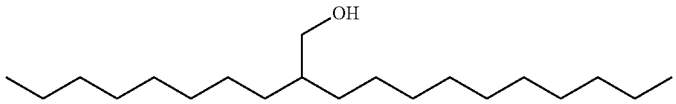 |
| Group I oil (linear, branched, cyclic, naphthenic hydrocarbon) (C14-C18) mixtures | 40-70% | 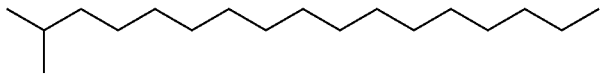 |
| Aliphatic adipate ester | 30-50% | 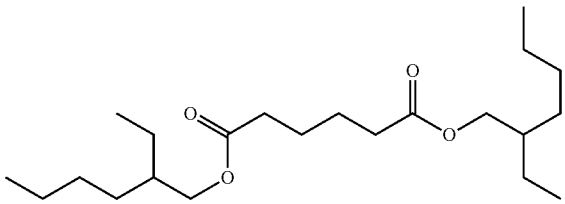 |

In embodiments, the solvency enhancer can include the at least one Guerbet alcohol in an amount of about 40% to about 100%, an adipate ester in an amount of about 0% to about 5% and a base oil in an amount of about 0% to about 50% by weight relative to the total weight of the solvency enhancer. In embodiments, the solvency enhancer can include the at least one Guerbet alcohol in an amount of about 50% to about 80%, an adipate ester in an amount of about 1% to about 10% and a base oil in an amount of about 10% to about 50% by weight relative to the total weight of the solvency enhancer. In embodiments, the solvency enhancer can include the at least one Guerbet alcohol in an amount of about 55% to about 80%, adipate ester in an amount of about 3% to about 6% and a base oil in an amount of about 20% to about 45% by weight relative to the total weight of the solvency enhancer. In various embodiments, the at least one Guerbet alcohol has about 24 carbon atoms, and the base oil can include a Group II and/or Group I mineral oil.

According to various embodiments as described herein, the oil composition may be in service for a period of about 1 month to about 12 months, or about 2 months to about 11 months, or about 3 months to about 10 months, or about 4 months to about 9 months, or about 5 months to about 8 months, or less than 6 months, or greater than 1 year, after the addition of the solvency enhancer. In embodiments, the oil composition may be in service within a mechanical system operating at a temperature of about −50° C. to about 230° C., or about −50° C. to about 50° C., or about 10° C. to about 80° C., or about 10° C. to about 120° C. or about 25° C. to about 230° C.

In yet further embodiments, methods as described herein can further include forming a working mixture. The working mixture can include lubricant oils as described herein, degradation byproducts, a solvency enhancer according to embodiments herein, and solvency enhancer degradation byproducts. The at least one Guerbet alcohol can be present in the working mixture at an amount of about 0.1% to about 30%, or about 1% to about 30%, or greater than 1.0% to about 30%, or about 3% to about 25%, or about 5% to about 22%, or about 10% to about 18%, or about 13% to about 15% by volume relative to the total volume of the working mixture. According to embodiments, the working mixture can have a lower ΔE value measured by a color spectrometer (e.g., Membrane Patch Colorimetry using ASTM D7843) than the oil composition prior to the addition of the solvency enhancer. In embodiments, the at least one Guerbet alcohol is present in an amount of greater than 1.0% to about 30%, or about 3% to about 25%, or about 5% to about 20% relative to the total volume of the working mixture. In embodiments, the total volume of the working mixture is from about 1 to about 10,000, or about 5 to about 9,000, or about 20 to about 8,000 gallons.

Methods as described herein are compatible with the subsequent addition or co-addition of other additives such as antioxidants, extreme pressure agents, antiwear agents and defoamants.

Selection of Guerbet Alcohol

The solubility of base stocks and lubricants in the lubricating industry is measured using the aniline point. The base stocks are carrier oils without additives such as Group I, IL, III, IV or V base oils. However, the aniline point method alone may not always be the best manner of assessing solvency of a lubricant toward a contaminant such as lubricant degradation products. Hansen solubility parameters and the aniline point may be considered in the identification of the most effective solvency enhancer. Table 5 shows the intermolecular energy contributions (cal/mol) or Hansen solubility parameters for selected model compounds. Qualitatively, these parameters help in selecting a particular family of compounds to dissolve or keep in solution solutes of similar Hansen parameters. The techniques used for quantitative proper selection of blends to dissolve polymers are well described in the literature (see Hansen Solubility Parameters A User's Handbook, $2^{nd}$ edition. Charles M Hansen, 2007).

It has also been established in the literature that degradation byproducts of lubricating oil include fatty acids, peroxides, aldehydes, phenolic and aminic degradation compounds coming from the degradation of base stocks and antioxidant packages. See Leslie Rudnick, Lubricant *Additives Chemistry and Applications,* 2nd edition (2009); Maleville, et.al *Oxidation of Mineral Based Oils of Petroleum Origin. The relationship between chemical composition, thickening and composition of degradation. Lubrication Science*, Vol. 9, pp. 3-60 (1996). These compounds in terms of intermolecular interactions are the closest to the organic acids listed in Table 5 and these in turn are far removed from alkanes and aromatics (model compounds for oils such as benzene and octadecane). Many of these degradation compounds are carbonyl containing compounds which can further grow and polymerize into oil insoluble macromolecules that can form deposits. This indicates qualitatively that degradation byproducts formed due to oxidation are not soluble in mineral oils even at relatively low concentrations. At the same time, alkyl naphthalenes, a common co-solubilizer used in lubricants, may have limited benefits as a solvent enhancer at commercially viable treatment levels. On the other hand, Guerbet alcohols (e.g., dodecanol as a model compound) overlap well with fatty acids and other acidic degradation byproducts that are strongly polar and are capable of hydrogen bonding. It is a good model compound for degradation compounds from the point of view of intermolecular energies.

TABLE 5

Hansen Solubility Parameters of Selected Model Compounds and Key Reference Compounds

| Compound | Dispersion | Polar (p) | Hydrogen bonding (h) | Total Polar (p + h) |
|---|---|---|---|---|
| Water | 15.5 | 16 | 42.3 | 58.3 |
| Dodecanol | 16 | 5.2 | 11.5 | 16.7 |
| Aniline | 19.4 | 5.1 | 10.2 | 15.3 |
| Octanoic acid | 15 | 3 | 8.2 | 11.2 |
| N-butyl acetate | 15.8 | 3.7 | 6.3 | 10 |
| oleic acid | 16 | 2.8 | 6.2 | 9 |
| octyl acetate | 15.8 | 2.9 | 5.1 | 8 |
| methyl Naphthalene | 21 | 0.8 | 4.7 | 5.5 |
| benzene | 18.4 | 0 | 2 | 2 |
| octadecane | 16.4 | 0 | 0 | 0 |

In some embodiments, solvency enhancers include those with Hansen solubility parameters with a polar parameter between 3 and 7, and a hydrogen bonding parameter between 7 and 15. The dispersion component is less crucial due to the invariable nature of this parameter for most organic compounds—ranging between 13 and 17. See Charles M Hansen, *Hansen Solubility Parameters A User's Handbook,* 2nd edition (2007).

In order to select the best solvency enhancer, one must not only consider the solvency of the working mixture toward degradation compounds, but also other critical parameters. According to embodiments, preferred Guerbet alcohols are those with a Noack volatility (ASTM D-5800) at a temperature of 150° C. comparable or lower than Group I and II mineral oils, which minimizes evaporative loses in order to maintain solubilizing properties (see Table 6). Table 6 shows that there is significant variation in volatility. Preferably, the solvency enhancer needs to be selected with Noack Volatility levels close to 17%, the volatility of the target oil. This is particularly the case for applications where the working mixture is used as a coolant and lubricant, and losses due to evaporation must be avoided. These losses could result in rapid deposit formation once the critical solvent enhancer concentration drops below the solubility threshold level of the mixture (a solvent enhancer plus a in-service fluid).

TABLE 6

Noack Volatility of Various Solvent Enhancers and Base Stocks

| | Oil Group I | Guerbet Alcohol A ($C_{18}$) | Guerbet Alcohol B ($C_{18}$) | Guerbet Alcohol C ($C_{24}$) | Group V solvent enhancer |
|---|---|---|---|---|---|
| % weight loss Noack Volatility (150° C.) | 16.72% | 71.63% | 78.68% | 14.5% | 11% |

Although flammability properties do not directly impinge on deposit control properties, it is important to consider them in selecting a particular solvency enhancer. Table 7 shows observed flash points reported for various solvency enhancers. Preferred solvency enhancers are those with the highest flash point.

TABLE 7

Flash Point of Various Solvent Enhancers and Base Stocks

| | Oil Group I | Guerbet Alcohol A ($C_{18}$) | Guerbet Alcohol B ($C_{18}$) | Guerbet Alcohol C ($C_{24}$) | Group V solvent enhancer |
|---|---|---|---|---|---|
| Flash point ASTM D-93 PMCC (C.) | 200< | 200< | 200< | 220< | 230< |

Interfacial surface energies (mN/m or dyn/cm) are considered in selecting a solvency enhancer to minimize the likelihood of emulsification. This is of particular concern in steam powered or hydroelectric turbines where water ingression is always a risk. Emulsions can result in antioxidant additive extraction and chemical reactions that result in fatty acid formation, which, due to their insolubility in the lubricant, can form deposits. Table 8 shows the interfacial energy of several solvency enhancers considered and a Group I oil as a reference.

TABLE 8

Interfacial Tension of Various Guerbet Alcohols, a Base Oil and an Alternate Solvent Enhancer

| | Oil Group I | Alkylated Naphthalene | Guerbet Alcohol A $C_{18}$ | Guerbet Alcohol B $C_{18}$ | Guerbet Alcohol $C_{24}$ |
|---|---|---|---|---|---|
| Interfacial Tension ASTM D971 @ 25° C. | 26.72 | 41.06 | 27.67 | 13.84 | 30.93 |

According to embodiments, the interfacial surface tension should be as high as possible while maintaining the other overall lubricant properties. According to various embodiments, preferred Guerbet alcohols can have an interfacial energy higher than 27 dyn/cm. This is in order to maintain demulsibility characteristics of the working mixture, while at the same time solubilizing oxidation byproducts formed during the use of the oil composition at typical operating temperatures (10° C. to 140° C.).

According to various methods described herein, Guerbet alcohols ranging in carbon chain from $C_{12}$-$C_{32}$ can be added to the oil composition to dissolve oxidation products formed and suspended in the oil composition. A suitable Original Equipment Manufacturer (OEM) specification for turbine oils and/or hydraulic oils is shown in Table 9.

TABLE 9

Original Equipment Manufacturer (OEM) specification for turbine oils and/or hydraulic oils.

| Test | Test Method |
|---|---|
| 40° C. Viscosity | D445 |
| 100° C. Viscosity | D445 |
| Viscosity Index | D2270 |
| Volatility/Oil Thickening | DIN 51356 |
| Density @ 15° C. | D941/D1298 |
| Gravity (° API) | D287 |
| Specific Gravity, 15.56° C. | D1298 |
| Color | D1500 |
| Flash Point, C.O.C, ° C. | D92 |
| Fire Point, C.O.C, ° C. | D92 |
| Flash Point, PMCC, ° C. | D93 |
| Autoignition Temp, ° C. | E659 |
| Pour Point, ° C. | D97 |
| Acid Number | D664/D974 |
| Neutralization Coefficient | D974 |
| Air Release, 50° C., minutes | D3427 |
| Foaming, Seq I | D892 |
| Foaming, Seq II | D892 |
| Foaming, Seq III | D892 |
| Evaporation Loss, 149° C., wt % | D972 |
| Demulsibility after Steam Treatment | DIN 51589 Part I |
| Water Separability, 54° C. | D1401 |
| Particle count | ISO 4406 |
| Water Content | D1533/D1744 |
| Solid Foreign Particles | Membrane Filtration |
| TOST | D943 |
| TOST, Acid Number After 1000 hr | D943 |
| DryTOST @ 120° C., Sludge on 1 um filter | Dry D943/D2272 |
| RPVOT, minutes | D2272 |
| RPVOT (Modified), minutes | D2272 |
| CM Thermal Test A | Thermal Stability |
| Panel Coker Test | FTM 791a-3462 |
| Copper Corrosion, 100° C. 3 h | D130 |
| Rust Test, Sea Water | D665 |
| Rust Test, Sea Water, 24 hr @ 60° C. | D665 |
| FZG Fail Stage, normal test A/8.3/90 | DIN 51354-2 |
| 4-Ball Wear, Scar Diameter in mm @ 40 kg | D4172 |
| Filterability | ISO 13357-2 |
| Ramsbottom Carbon Residue, mass % | D524 |
| Carbon Residue-Micro Method | D4530 or equivalent |
| Ash (oxide ash), Mass % | D482 |

The at least one Guerbet alcohol can be added as part of a formulation of the solvency enhancer that can be used as a tank side additive package to "in-service" fully formulated lubricating oils, heat transfer fluids, and/or hydraulic fluids. The resulting working mixture can have a lower varnish potential than the working lubricant or hydraulic fluid.

The target fluids include formulated lubricating oils (including, but not limited to, turbine oil and gear oils) or hydraulic fluids utilizing at least one of an API Group I, Group II, Group III or Group IV base oil. The addition of the at least one Guerbet alcohol can solubilize degradation products suspended in the oil-alcohol matrix (working mixture) and it can maintain in solution compounds solubilized in the oil-alcohol matrix. The potential for deposit formation in lubricating oils such as rust and oxidation (R&O) oils, compressor oils, hydraulic fluids and gear oils among others is determined via ASTM 7843 also known as Membrane Patch Colorimetry (MPC). Higher values of ΔE indicate a higher potential for deposit (varnish) formation. The ΔE is the difference in color between two (2) colors in the CIE LAB color scale. In the case of the MPC test, it is the difference between the white of the unstained MPC patch and the stained patch after the sample has been filtered through it.

According to various embodiments, solvency enhancer formulations can include formulations of at least one Guerbet alcohol having 24 carbon atoms (about 55 wt % to about 65 wt %) and a Group II and/or a Group I mineral oil (about 20 wt % to about 45 wt %). The mixture can also include an adipate ester (about 3 wt % to about 6 wt %) as a co-solubilizer. These formulations can be used for rotating equipment lubricants with viscosities ranging from ISO 32 cSt to ISO 320 cSt. The resulting working mixture can have a minimum of 50% or larger reduction of ΔE value while maintaining all of the lubricating properties intact (Tables 5-8) and one or more Guerbet alcohol that meets those the requirements (e.g., a $C_{24}$ Guerbet alcohol). This reduction is expected to be measurable in about 1 day to about 3 days of operation. These formulations are to be used when the working mixture is used for about 1 month to about 12 months after the treatment with the solvency enhancer has been conducted and prior to an oil change.

According to embodiments, disclosed herein are methods for dissolving organic deposits in an oil composition, for example, where the oil composition is contained within an oil system (e.g., a mechanical apparatus). The oil composition can include at least one of a lubricating oil, a heat transfer fluid, a hydraulic oil, a mineral formulation, a synthetic formulation and combinations thereof. In embodiments, the organic deposits can include agglomerated degradation byproducts of a base oil, antioxidants, or other additives, wherein the other additives comprise defoamants and co-solubilizers, for example, silicon containing defoamants, and the formation of 2-ethylhexanoic acid from the degradation of adipate ester co-solubilizers.

In embodiments, the lubricating oil can include, but is not limited to, a turbine oils, a compressor oil, a paper machine refrigerant oil, a gear oil and combinations thereof. In embodiments, the hydraulic oil can include, but is not limited to, a non-aqueous mineral oil, a synthetic oil and combinations thereof. The hydraulic oils may be used in excavators and backhoes, hydraulic brakes, power steering systems, transmissions, garbage trucks, aircraft flight control systems, lifts, and industrial machinery. Methods according to various embodiments herein can be used to dissolve organic deposits in such applications. In embodiments, the heat transfer fluid can include, but is not limited to at least one coolant, at least one nanofluid, at least one heat transfer oil and combinations thereof.

Methods for dissolving organic deposits in an oil composition can include adding an effective amount of a solvency enhancer as a tank side additive to the oil composition. According to embodiments, the solvency enhancer includes at least one Guerbet alcohol. The at least one Guerbet alcohol can have about 12 to about 32 carbon atoms, about 12 to about 18 carbon atoms, about 18 to about 30 carbon atoms or about 18 to about 24 carbon atoms. In embodiments, the at least one Guerbet alcohol can have about 18 to about 24 carbon atoms. The at least one Guerbet alcohol can have a Noack volatility (as measured using ASTM D5800) at a level of about 5 wt % to about 30 wt %, or about 8 wt % to about 25 wt %, or about 10 wt % to about 18 wt % of the total oil composition. In embodiments, the at least one Guerbet alcohol can have Hansen solubility parameters including a dispersion (D) parameter of about 14 $MPa^{1/2}$ to about 20 $MPa^{1/2}$ or about 15 $MPa^{1/2}$ about 18 $MPa^{1/2}$, a polar (P) parameter of about 3.0 $MPa^{1/2}$ to about 7.0 $MPa^{1/2}$, or about 3.5 $MPa^{1/2}$ to about 6.5 $MPa^{1/2}$, or about 3.5 $MPa^{1/2}$ to about 5.5 $MPa^{1/2}$, about 4.0 $MPa^{1/2}$ to about 5.5 $MPa^{1/2}$ or about 5.0 $MPa^{1/2}$ to about 5.5 $MPa^{1/2}$ and/or a hydrogen bonding (H) parameter of about 7 $MPa^{1/2}$ to about 15 $MPa^{1/2}$, or about 8 $MPa^{1/2}$ to about 14 $MPa^{1/2}$, or about 8 $MPa^{1/2}$ to about 13 $MPa^{1/2}$, or about 8 $MPa^{1/2}$ to about 12 $MPa^{1/2}$, or about 9 $MPa^{1/2}$ to about 12 $MPa^{1/2}$, or about 10 $MPa^{1/2}$ to about 12 $MPa^{1/2}$.

In embodiments, the at least one Guerbet alcohol can have an interfacial surface energy of about 15 mN/m to about 45 mN/m, or about 20 mN/m to about 40 mN/m, or about 25 mN/m to about 35 mN/m. In embodiments, the at least one Guerbet alcohol has an aniline point of about −10° C. to about 40° C., or about −10° C. to about 37° C., or about 5° C. to about 40° C. or about 7° C. to about 37° C. According to embodiments, a solvency enhancer as described herein can include the one or more Guerbet alcohol in an amount of about 30% to about 100%, or about 40% to about 100%, or about 40% to about 80%, or about 50% to about 80%, or about 50% to about 75%, or about 50% to about 70%, or about 55% to about 65%, or 60% to about 62% by weight relative to the total weight of the solvency enhancer.

In further embodiments, the solvency enhancer includes an adipate ester in an amount of about 0% to about 20%, or about 1% to about 15%, or about 1% to about 10%, or about 2 to about 9%, or about 0% to about 5%, or about 3% to about 6% by weight relative to the total weight of the solvency enhancer. In further embodiments, the solvency enhancer includes a base oil in an amount of about 0% to about 70%, or about 0% to about 60%, or about 5% to about 60%, or about 0% to about 50%, or about 10% to about 50%, or about 15% to about 50%, or about 17% to about 48%, or about 20% to about 45% by weight relative to the total weight of the solvency enhancer. In embodiments, the solvency enhancer can include the at least one Guerbet alcohol in an amount of about 40% to about 100%, an adipate ester in an amount of about 0% to about 5% and a base oil in an amount of about 0% to about 50% by weight relative to the total weight of the solvency enhancer. In embodiments, the solvency enhancer can include the at least one Guerbet alcohol in an amount of about 50% to about 80%, an adipate ester in an amount of about 1% to about 10% and a base oil in an amount of about 10% to about 50% by weight relative to the total weight of the solvency enhancer. In embodiments, the solvency enhancer can include the at least one Guerbet alcohol in an amount of about 55% to about 80%, adipate ester in an amount of about 3% to about 6% and a base oil in an amount of about 20% to about 45% by weight relative to the total weight of the solvency enhancer. In various embodiments, the at least one Guerbet alcohol has about 24 carbon atoms, and the base oil can include a Group II and/or Group I mineral oil.

According to various embodiments as described herein, the oil composition may be in service for a period of about 1 month to about 12 months, or about 2 months to about 11 months, or about 3 months to about 10 months, or about 4 months to about 9 months, or about 5 months to about 8 months, or less than 6 months, or greater than 1 year, after the addition of the solvency enhancer. In embodiments, the oil composition may be in service within a mechanical system operating at a temperature of about −50° C. to about 230° C., or about −50° C. to about 50° C., or about 10° C. to about 80° C., or about 10° C. to about 120° C. or about 25° C. to about 230° C.

In yet further embodiments, methods as described herein (e.g., for dissolving organic deposits) can further include forming a working mixture. The working mixture can include lubricant oils as described herein, degradation byproducts, a solvency enhancer according to embodiments herein, and solvency enhancer degradation byproducts. The at least one Guerbet alcohol can be present in the working mixture at an amount of about 0.1% to about 30%, or about 1% to about 30%, or greater than 1.0% to about 30%, or about 3% to about 25%, or about 5% to about 22%, or about 10% to about 18%, or about 13% to about 15% by volume relative to the total volume of the working mixture. According to embodiments, the working mixture can have a lower ΔE value measured by a color spectrometer (e.g., Membrane Patch Colorimetry using ASTM D7843) than the oil composition prior to the addition of the solvency enhancer. In embodiments, the at least one Guerbet alcohol is present in an amount of greater than 1% to about 30%, or about 3.0% to about 25%, or about 5.0% to about 20% relative to the total volume of the working mixture. In embodiments, the total volume of the working mixture is greater than about 1 gallon, or from about 1 gallon to about 10,000 gallons, or about 5 gallons to about 9,000 gallons, or about 20 gallons to about 8,000 gallons.

According to embodiments, the method can further include combining in service oil compositions with the solvency enhancer to solubilize degradation derived organic deposits. The working mixture can clean solid surfaces by solubilizing the organic deposits. In embodiments, the working mixture can include newly solubilized species from the organic deposits.

Methods as described herein are compatible with the subsequent addition or co-addition of other additives such as antioxidants, extreme pressure agents, antiwear agents and defoamants.

In embodiments, the oil system, prior to the addition of the solvency enhancer, comprises an API Group I base oil, a Group II base oil, a Group III base oil, a Group IV base oil, a Group V base oil or a combination thereof.

According to embodiments, at least one Guerbet alcohol ranging in size from about 12 to about 32 carbon atoms as part of a solvency enhancer and as tank side additives are used to clean inner surface deposits from the degradation of lubricants (turbines, gear boxes, other), heat transfer fluids and hydraulic fluids. In embodiments, at least one Guerbet alcohols having 18 carbon atoms is present in the working mixture in an amount of 20 wt % to about 100 wt % and at least one Guerbet alcohol having 24 carbon atoms is present in an amount of 20 wt % to about 100 wt %. These formulations comprising at least one Guerbet alcohol can be used for surface cleaning by mixing with the existing working fluids to create a working mixture that is compatible with chemical oil purification methods based on adsorption of polar component such as Fluitec's ESP technology. In embodiments, methods of use include treatment of the working fluid 1 to 24 weeks in advance of the disposal of the working mixture depending on the timing needs for the clean-out of the equipment.

In embodiments, the solvency enhancer can include at least one Guerbet alcohol with a vapor pressure comparable to mineral oil as described above, and can also include at least one Guerbet alcohol having 12 to 18 carbon atoms (CU-Cis). A suitable solvency enhancer formulation is shown in Table 10.

TABLE 10

| Solvency Enhancer Formulation | | |
|---|---|---|
| Chemical(s) | Vol. % based on Total Volume | Chemical Formula |
| 2-hexyldecanol (C16) | 40-70% | 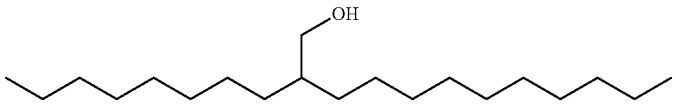 |
| 16-Methylheptadecanol ((Isostearyl alcohol)) (C18) | 20-50% | 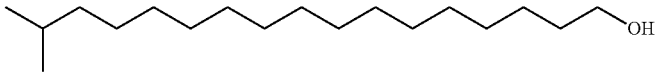 |

These alcohols due to their reduced molecular weight have a larger hydrogen bond and polar contribution than their equivalent longer chain length related compounds. In turn, these contributions accelerate their solubilizing of polar deposits capable of hydrogen bonding. Shorter chain length Guerbet alcohols ($C_{12}$-$C_{18}$) exhibit higher vapor pressures, so these formulations can be used in cleaning applications where the working mixture is in service for a maximum of 24 weeks to minimize evaporative losses. Blending of these alcohols allows customizing of the cleaning power and cleaning time. A larger content of $C_{12}$-$C_{18}$ Guerbet alcohols allows for a rapid cleaning in applications that require short cleaning times and lower temperatures. This is especially valuable in applications where the working mixture may not be lubricating an operational system i.e. the equipment is shut-off and the working mixture is only working as a cleaning mixture.

Preferred embodiments include those with Hansen solubility parameters (5-7p and 8-14 h) and interfacial surface energies between 13-30 dyn/cm. As the application for the cleaning of surface deposits is for a shorter time, the risk of emulsification due to water leaks is lower and lower interfacial surface tensions may be used. For those applications where water is already present in the system a solvent enhancer with higher interfacial surface energy is preferred.

The resulting working mixture after treatment of the solvency enhancer can include about 3 wt % to about 20 wt % of at least one Guerbet alcohol with the balance being a fully formulated lubricating oil or hydraulic fluid utilizing at least one of an API Group I, Group II, Group III and Group IV base oil. These formulations can include about 0 wt % to about 100% of a Guerbet alcohol having 18 carbons and about 0 wt % to about 100% of a Guerbet alcohol having 24 carbons. For systems below 30° C., about 100% of a Cis Guerbet alcohol can be used. For systems between 30° C. and 50° C., blends of 60% $C_{18}$ and $C_{24}$ Guerbet alcohols can be used and for systems above 50° C. and 70° C., 100% a $C_{24}$ Guerbet alcohol can be used.

According to further embodiments, the present disclosure provides a method for reducing and/or preventing sludge and/or varnish formation in an oil composition. In embodiments, a lubricating oil can be formulated with the solvency enhancer such that the lubricating oil when placed into service already includes the solvency enhancer. Such formulation can prevent the formation of deposits by maintaining them in solution as the oil is oxidatively degraded. The oil composition can include at least one of a lubricating oil, a heat transfer fluid, a hydraulic oil, a mineral formulation, a synthetic formulation and combinations thereof.

In embodiments, the lubricating oil can include, but is not limited to, a turbine oils, a compressor oil, a paper machine refrigerant oil, a gear oil and combinations thereof. In embodiments, the hydraulic oil can include, but is not limited to, a non-aqueous mineral oil, a synthetic oil and combinations thereof. The hydraulic oil may be used in excavators and backhoes, hydraulic brakes, power steering systems, transmissions, garbage trucks, aircraft flight control systems, lifts, and industrial machinery. Methods according to various embodiments herein can be used to dissolve organic deposits in such applications. In embodiments, the heat transfer fluid can include, but is not limited to at least one coolant, at least one nanofluid, at least one heat transfer oil and combinations thereof.

Methods for reducing and/or preventing sludge and/or varnish formation in an oil composition can include adding an effective amount of a solvency enhancer as a tank side additive to the oil composition. According to embodiments, the solvency enhancer includes at least one Guerbet alcohol. The at least one Guerbet alcohol can have about 12 to about 32 carbon atoms, about 12 to about 18 carbon atoms, about 18 to about 30 carbon atoms or about 18 to about 24 carbon atoms. In embodiments, the at least one Guerbet alcohol can have about 18 to about 24 carbon atoms. The at least one Guerbet alcohol can have a Noack volatility (as measured using ASTM D5800) at a level of about 5 wt % to about 30 wt %, or about 8 wt % to about 25 wt %, or about 10 wt % to about 18 wt % of the total oil composition. In embodiments, the at least one Guerbet alcohol can have Hansen solubility parameters including a dispersion (D) parameter of about 14 $MPa^{1/2}$ to about 20 $MPa^{1/2}$ or about 15 $MPa^{1/2}$ about 18 $MPa^{1/2}$, a polar (P) parameter of about 3.0 $MPa^{1/2}$ to about 7.0 $MPa^{1/2}$, or about 3.5 $MPa^{1/2}$ to about 6.5 $MPa^{1/2}$, or about 3.5 $MPa^{1/2}$ to about 5.5 $MPa^{1/2}$, about 4.0 $MPa^{1/2}$ to about 5.5 $MPa^{1/2}$ or about 5.0 $MPa^{1/2}$ to about 5.5 $MPa^{1/2}$ and/or a hydrogen bonding (H) parameter of about 7 $MPa^{1/2}$ to about 15 $MPa^{1/2}$, or about 8 $MPa^{1/2}$ to about 14 $MPa^{1/2}$, or about 8 $MPa^{1/2}$ to about 13 $MPa^{1/2}$, or about 8 $MPa^{1/2}$ to about 12 $MPa^{1/2}$, or about 9 $MPa^{1/2}$ to about 12 $MPa^{1/2}$, or about 10 $MPa^{1/2}$ to about 12 $MPa^{1/2}$.

In embodiments, the at least one Guerbet alcohol can have an interfacial surface energy of about 15 mN/m to about 45 mN/m, or about 20 mN/m to about 40 mN/m, or about 25 mN/m to about 35 mN/m. In embodiments, the at least one Guerbet alcohol has an aniline point of about −10° C. to about 40° C., or about −10° C. to about 37° C., or about 5° C. to about 40° C. or about 7° C. to about 37° C. According to embodiments, a solvency enhancer as described herein can include the one or more Guerbet alcohol in an amount of about 30% to about 100%, or about 40% to about 100%, or about 40% to about 80%, or about 50% to about 80%, or about 50% to about 75%, or about 50% to about 70%, or about 55% to about 65%, or 60% to about 62% by weight relative to the total weight of the solvency enhancer.

In further embodiments, the solvency enhancer includes an adipate ester in an amount of about 0% to about 20%, or about 1% to about 15%, or about 1% to about 10%, or about 2 to about 9%, or about 0% to about 5%, or about 3% to about 6% by weight relative to the total weight of the solvency enhancer. In further embodiments, the solvency enhancer includes a base oil in an amount of about 0% to about 70%, or about 0% to about 60%, or about 5% to about 60%, or about 0% to about 50%, or about 10% to about 50%, or about 15% to about 50%, or about 17% to about 48%, or about 20% to about 45% by weight relative to the total weight of the solvency enhancer. In embodiments, the solvency enhancer can include the at least one Guerbet alcohol in an amount of about 40% to about 100%, an adipate ester in an amount of about 0% to about 5% and a base oil in an amount of about 0% to about 50% by weight relative to the total weight of the solvency enhancer. In embodiments, the solvency enhancer can include the at least one Guerbet alcohol in an amount of about 50% to about 80%, an adipate ester in an amount of about 1% to about 10% and a base oil in an amount of about 10% to about 50% by weight relative to the total weight of the solvency enhancer. In embodiments, the solvency enhancer can include the at least one Guerbet alcohol in an amount of about 55% to about 80%, adipate ester in an amount of about 3% to about 6% and a base oil in an amount of about 20% to about 45% by weight relative to the total weight of the solvency enhancer. In various embodiments, the at least one Guerbet alcohol has about 24 carbon atoms, and the base oil can include a Group II and/or Group I mineral oil.

According to various embodiments as described herein, the oil composition may be in service for a period of about 1 month to about 12 months, or about 2 months to about 11 months, or about 3 months to about 10 months, or about 4 months to about 9 months, or about 5 months to about 8 months, or less than 6 months, or greater than 1 year, after the addition of the solvency enhancer. In embodiments, the oil composition may be in service within a mechanical system operating at a temperature of about −50° C. to about 230° C., or about −50° C. to about 50° C., or about 10° C. to about 80° C., or about 10° C. to about 120° C. or about 25° C. to about 230° C.

In yet further embodiments, methods as described herein (e.g., for dissolving organic deposits) can further include forming a working mixture. The working mixture can include lubricant oils as described herein, degradation byproducts, a solvency enhancer according to embodiments herein, and solvency enhancer degradation byproducts. The at least one Guerbet alcohol can be present in the working mixture at an amount of about 0.1% to about 30%, or about 1% to about 30%, or greater than 1.0% to about 30%, or about 3% to about 25%, or about 5% to about 22%, or about 10% to about 18%, or about 13% to about 15% by volume relative to the total volume of the working mixture. According to embodiments, the working mixture can have a lower ΔE value measured by a color spectrometer (e.g., Membrane Patch Colorimetry using ASTM D7843) than the oil composition prior to the addition of the solvency enhancer. In embodiments, the at least one Guerbet alcohol is present in an amount of greater than 1% to about 30%, or about 3% to about 25%, or about 5% to about 20% relative to the total volume of the working mixture. In embodiments, the total volume of the working mixture is greater than about 1 gallon, or from about 1 gallon to about 10,000 gallons, or about 5 gallons to about 9,000 gallons, or about 20 gallons to about 8,000 gallons.

According to embodiments, the method can further include combining in service oil compositions with the solvency enhancer to solubilize degradation derived organic deposits. The working mixture can clean solid surfaces by solubilizing the organic deposits. In embodiments, the working mixture can include newly solubilized species from the organic deposits. Methods as described herein are compatible with the subsequent addition or co-addition of other additives such as antioxidants, extreme pressure agents, antiwear agents and defoamants.

In embodiments, the oil system, prior to the addition of the solvency enhancer, comprises an API Group I base oil, a Group II base oil, a Group III base oil, a Group IV base oil, a Group V base oil or a combination thereof.

According to embodiments, at least one Guerbet alcohol ranging in size from about 12 to about 32 carbon atoms as part of a solvency enhancer and as tank side additives are used to clean inner surface deposits from the degradation of lubricants (turbines, gear boxes, other), heat transfer fluids and hydraulic fluids. In embodiments, at least one Guerbet alcohol having 18 carbon atoms is present in the working mixture in an amount of 20 wt % to about 100 wt % and at least one Guerbet alcohol having 24 carbon atoms is present in an amount of 20 wt % to about 100 wt %. These formulations comprising at least one Guerbet alcohol can be used for surface cleaning by mixing with the existing working fluids to create a working mixture that is compatible with chemical oil purification methods based on adsorption of polar component such as Fluitec's ESP technology. In embodiments, methods of use include treatment of the working fluid 1 to 24 weeks in advance of the disposal of the working mixture depending on the timing needs for the clean-out of the equipment.

In embodiments, the solvency enhancer can include at least one Guerbet alcohol with a vapor pressure comparable to mineral oil as described above, and can also include at least one Guerbet alcohol having 12 to 18 carbon atoms ($C_{12}$-$C_{18}$). These alcohols due to their reduced molecular weight have a larger hydrogen bond and polar contribution than their equivalent longer chain length related compounds. In turn, these contributions accelerate their solubilizing of polar deposits capable of hydrogen bonding. Shorter chain length Guerbet alcohols ($C_{12}$-$C_{18}$) exhibit higher vapor pressures, so these formulations can be used in cleaning applications where the working mixture is in service for a maximum of 24 weeks to minimize evaporative losses. Blending of these alcohols allows customizing of the cleaning power and cleaning time. A larger content of $C_{12}$-$C_{18}$ Guerbet alcohols allows for a rapid cleaning in applications that require short cleaning times and lower temperatures. This is especially valuable in applications where the working mixture may not be lubricating an operational system i.e. the equipment is shut-off and the working mixture is only working as a cleaning mixture.

Preferred embodiments include those with Hansen solubility parameters (5-7p and 8-14 h) and interfacial surface energies between 13-30 dyn/cm. As the application for the cleaning of surface deposits is for a shorter time, the risk of emulsification due to water leaks is lower and lower interfacial surface tensions may be used. For those applications where water is already present in the system a solvent enhancer with higher interfacial surface energy is preferred.

The resulting working mixture after treatment of the solvency enhancer can include about 3 wt % to about 20 wt % of at least one Guerbet alcohol with the balance being a fully formulated lubricating oil or hydraulic fluid utilizing at least one of an API Group I, Group II, Group III and Group IV base oil. These formulations can include about 0 wt % to about 100% of a Guerbet alcohol having 18 carbons and about 0 wt % to about 100% of a Guerbet alcohol having 24 carbons. For systems below 30° C., about 100% of a Cis Guerbet alcohol can be used. For systems between 30° C. and 50° C., blends of 60% $C_{18}$ and $C_{24}$ Guerbet alcohols can be used and for systems above 50° C. and 70° C., 100% a $C_{24}$ Guerbet alcohol can be used.

According to embodiments, methods as described herein reduce and/or prevent deposit formation in "in-service" fully formulated lubricating oils and hydraulic fluids. The method uses at least one Guerbet Alcohol having about 12 to about 32 carbon atoms. The addition of the at least one Guerbet alcohol can reduce and/or prevent further varnish and/or sludge formation in the working mixture of lubricating oils and hydraulic fluid.

The oxidation of the working mixtures with Guerbet alcohols ranging in size from about 12 to about 32 carbons in operating systems (e.g. lubricating oils, hydraulic fluids, heat transfer fluids) produces degradation products including fatty acids and aldehydes from both the oil and the alcohol. These products, however, are themselves soluble in the resulting working mixture.

EXAMPLES

Example 1—Treatment of In-Service Oils with a Guerbet Alcohol in the Range of $C_{18}$-$C_{24}$ for Reducing Varnish Formation A test was performed by treating the lubricating oil of a gas turbine for 4 years containing amine antioxidants only with a $C_{24}$ Guerbet alcohol. As shown in Table 11, the aniline point of the resulting working mixture is barely different for the treated sample vs the untreated sample (115° C. vs 114° C.), but the dE value is significantly different: dE 48 for the untreated sample vs 6 for the treated sample. Hansen Parameters are a better indicator of the potential effectiveness of a solvent enhancer and ultimately solvency testing must be conducted by actual measurement of the varnish potential. The data also highlights that a correct selection of a solvent enhancer also requires to ensure that other key properties of the working fluids are maintained or improved e.g. foam.

TABLE 11

Results after Treating an In-Service Fluid with a $C_{24}$ Guerbet Alcohol

| Sample Description | In Service Oil | In Service Oil + C24 Guerbet Alcohol |
|---|---|---|
| Compatibility of Mixture | | |
| Aniline Point, C. | 115 | 114 |
| Fluid Clarity (rating/description) | 1 | 1 |
| Sediment (rating description) | 0 | 0 |
| Result (pass/fail) | Pass | Pass |
| Membrane Patch Colorimetry | | |
| ΔE | 48.2 | 9 |
| Weight of Residue | 31.8 | 15.4 |
| Demulsibility @ 54° C., ASTM D1401 | | |
| Oil/Water/Emulsion-Minutes | 40/40/0-30 | 40/40/0-20 |

TABLE 11-continued

Results after Treating an In-Service Fluid with a $C_{24}$ Guerbet Alcohol

| Sample Description | In Service Oil | In Service Oil + C24 Guerbet Alcohol |
|---|---|---|
| Foaming Characteristics, ASTM D892 | | |
| Sequence I, ml Foam/seconds to break | 250/0-175 | 180/0-127 |
| Viscosity, ASTM D445 | | |
| 100° C. Viscosity, cSt | 6.76 | 6.58 |
| 40° C. Viscosity, cSt | 44.24 | 42.49 |
| Viscosity Index | 107 | 106 |
| TAN, ASTM D664 (mg/KOH) | 0.40 | 0.37 |
| RPVOT, ASTM D2272 | | |
| (Min) | 36 | 35 |
| Particle Count Optical | | |
| Particle Code | 15/14/10 | 14/13/10 |

Figure 1B:
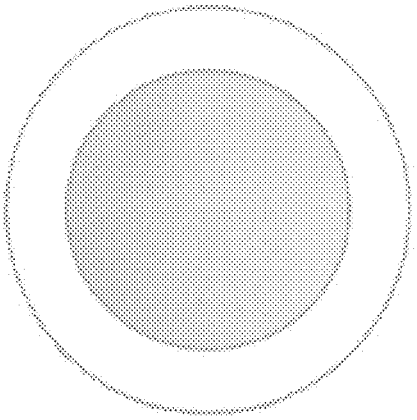
FIG. 1B depicts an in-service oil after treatment with a Guerbet alcohol.
Figure 2A:
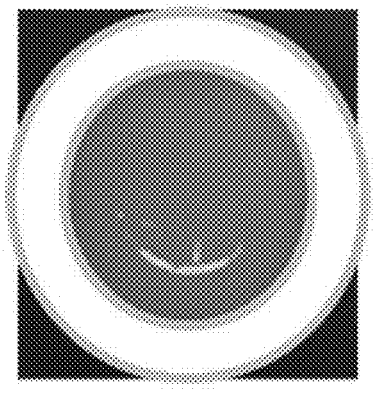
FIG. 2A depicts an in-service oil operating at room temperature before treatment with a Guerbet alcohol.
Figure 2B:
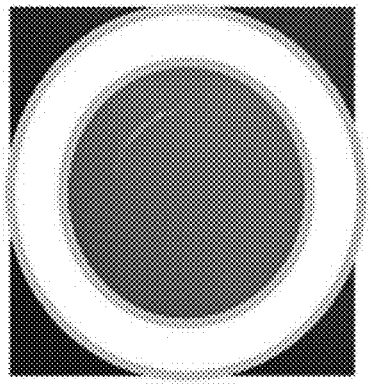
FIG. 2B depicts the in-service oil operating at room temperature after one hour of treatment with a Guerbet alcohol having 24 carbon atoms.
Figure 2C:
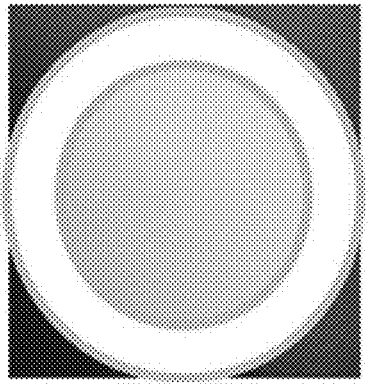
FIG. 2C depicts an in-service oil operating at room temperature after one hour of treatment with a Guerbet alcohol having 18 carbon atoms.
Figure 7:
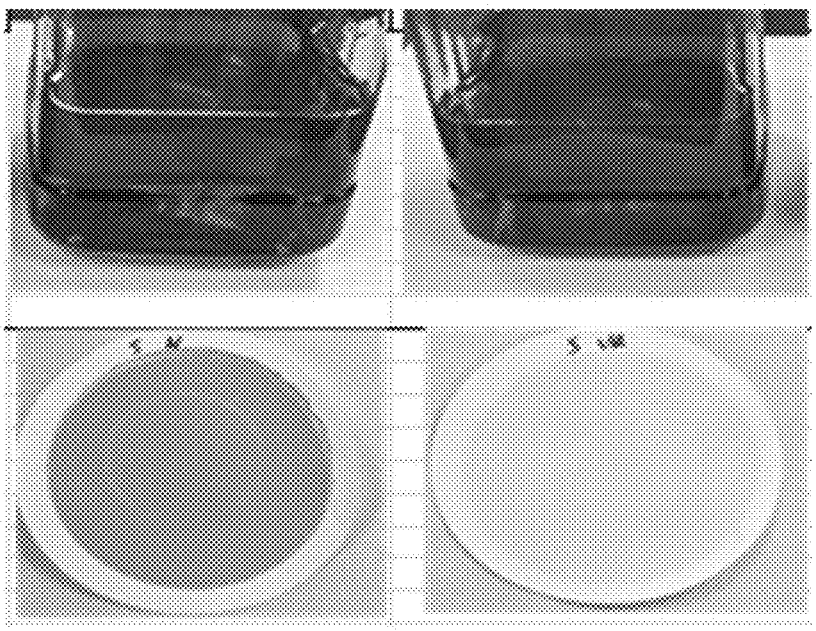
FIG. 7 shows the results after treating an in-service fluid with a Guerbet alcohol having 24 carbon atoms.

FIG. 7 shows the results after treating the in-service fluid with a $C_{24}$ Guerbet alcohol. A treatment with 5% $C_{24}$ Guerbet alcohols was added into the in-service oil, which further formed the working mixture. The treatment was conducted at only room temperature and for 1 hour. The patches were created by following the sample preparation protocol of ASTM D-7843. The method ensures that insoluble compounds come out of solution by placing the treated and untreated samples in a very nonpolar matrix (e.g., alkanes). If the oil sample has a strong polar/hydrogen bonding nature, the polar compounds will not come out of solution and the patch will be light in coloration. A less polar oil sample will be lighter as the insolubles compound will more readily come out of solution. FIG. 1A shows an image of an in-service oil with a high ΔE value (49). FIG. 1B shows the image of the same oil after treatment with a Guerbet alcohol in the range of $C_{18}$-$C_{24}$ with ΔE of 6. The images clearly show the effect in reducing the deposit formation potential of a contaminated or degraded industrial lubricant.

Figure 3A:
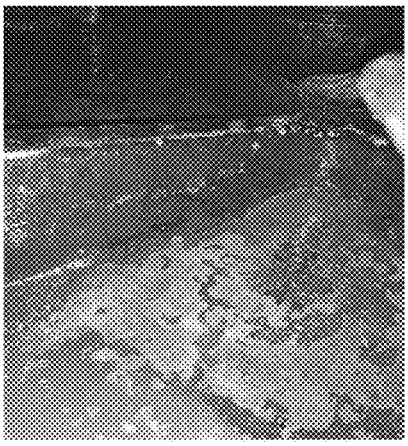
FIG. 3A shows a lubricant reservoir and mechanical component before treatment with a Guerbet alcohol.
Figure 3B:
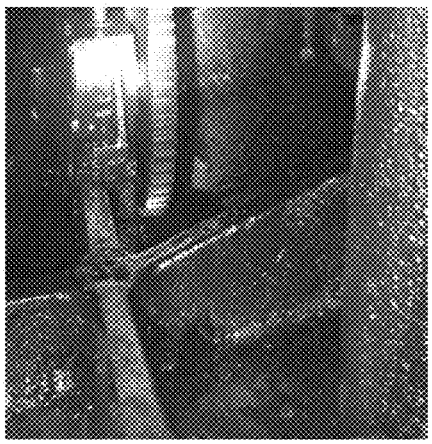
FIG. 3B shows a lubricant reservoir and mechanical component after treatment with a Guerbet alcohol having 24 carbon atoms at a 5 wt % treatment rate.

Example 2—Treatment of In-Service Oils with a Guerbet Alcohol in the Range of $C_{18}$-$C_{24}$ for Dissolving Organic Deposits A treat rate between 3% and 20.0% has been shown to be effective (FIG. 3). In this example, a 5% by volume $C_{24}$ Guerbet alcohol was added to an in-service gear oil lubricant (viscosity ISO 320 at 40° C.) during the operation of coal pulverizer. The operation was registering high temperatures and sludge formation was attributed as the cause of it. These higher operating temperatures reduce the useful life of the machine components. The gearbox temperature was recorded at 76° C. with spiking to 88° C. The images showed that the effective dissolution and therefore removal of deposit in the gearbox after the treatment of the $C_{24}$ Guerbet alcohol. The images were collected after 70 hours of run time demonstrating the rapid effect of the solvent enhancer.

Figure 4:
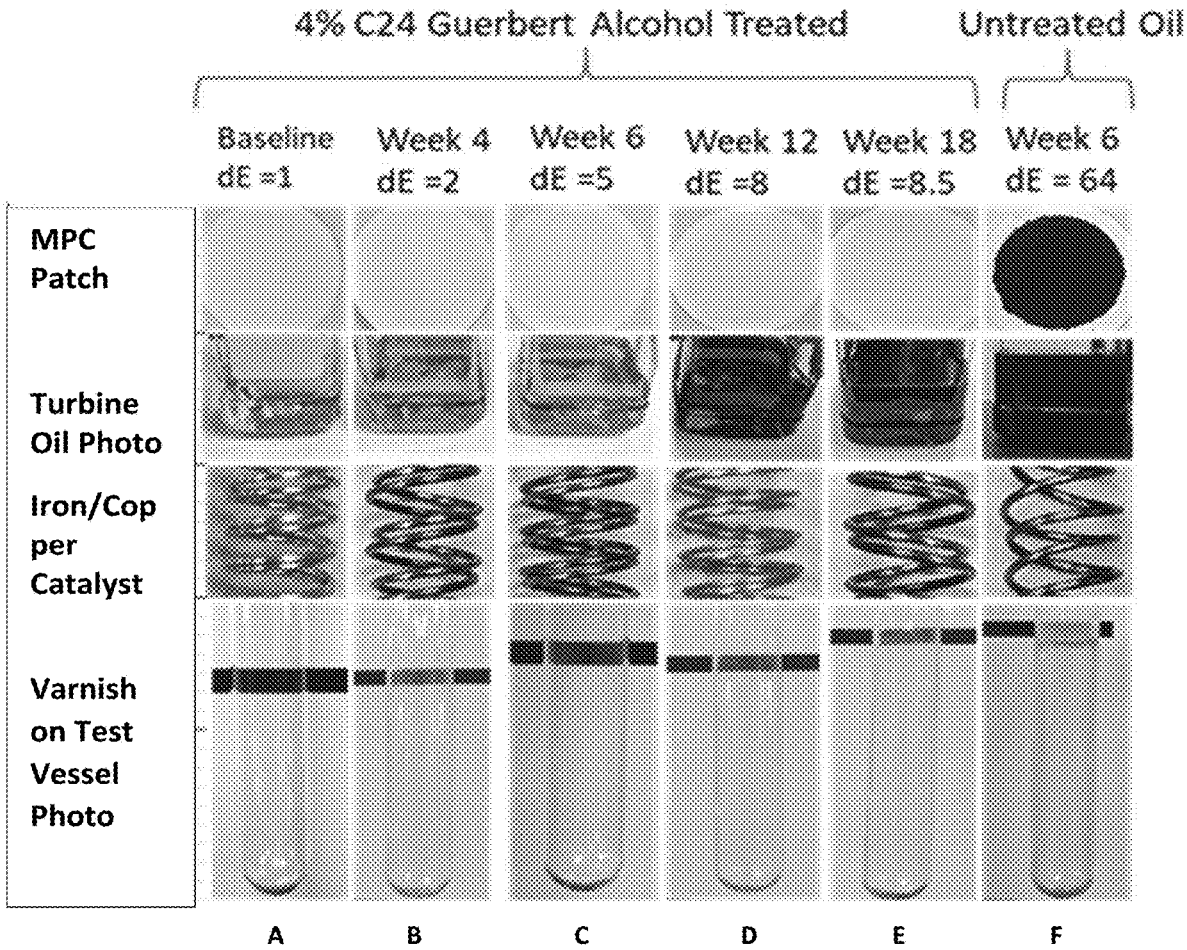
FIG. 4 shows the results from accelerated oxidations tests for lubricating turbine oils containing at least one Guerbet alcohol.

Example 3—Treatment of In-Service Oils with a Guerbet Alcohol in the Range of $C_{18}$-$C_{24}$ for Preventing Sludge Formation Accelerated oxidation tests conducted at 120° C. with iron/copper and air catalysts (FIG. 6), show no evidence of deposit formation after 18 weeks of oxidative stress testing as demonstrated by the MPC Test (ASTM D7843) and deposit inspections of the catalyst metal and test tube in which the test was conducted. One week of testing typically represents 1 year of operation. FIG. 4 shows the evolution of a fully formulated commercial oil treated with a $C_{24}$ Guerbet alcohol at 4% treat rate and compared against the untreated oil.

Figure 5:
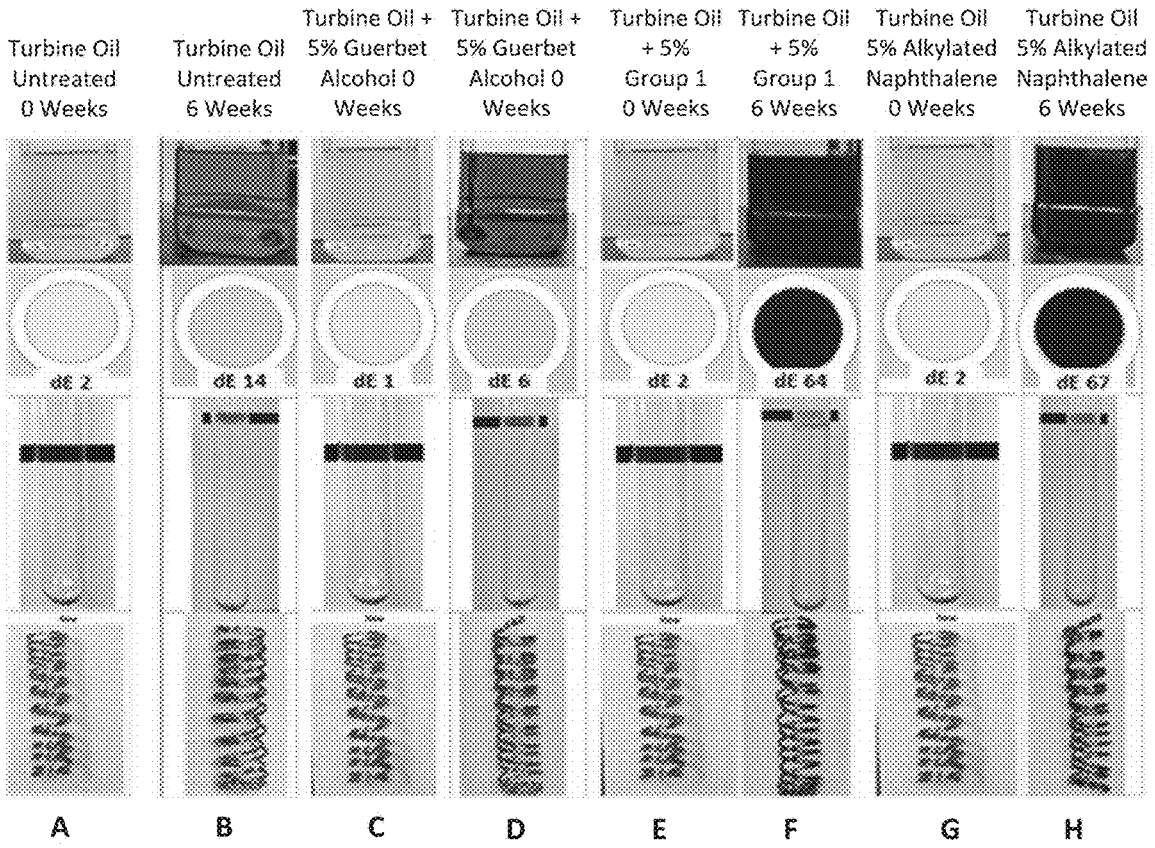
FIG. 5 depicts the accelerated aging via oxidation of turbine oil working mixtures after 6 weeks.

FIG. 5 shows the results after only a 6-week accelerated oxidation test. It indicates that the working mixture which contains the initial fluid, the degradation byproducts of this fluid, the Guerbet alcohol solvent enhancer and all the combined degradation products, displays superior long term performance in terms varnish potential and deposit formation compared to oils not treated with a solvent enhancer or treated with alternative solvent enhancers. The sample treated with Guerbet alcohol shows no evidence of deposit formation on the catalyst or the test tube and exhibits a low dE value for the MPC test. On the other hand, the alkylated naphthalene and Group I treated samples (both considered solvent enhancers) worsen when compared to the untreated sample. Due to the addition of Guerbet alcohols, the improved results compare very well against other solubilizing technologies such as Group I mineral oils and alkylated naphthalene. The degradation byproducts of these solvent enhancers along with the lubricating oil and its degradation byproducts are not soluble in the working mixture. Additional degradation tests have been conducted with various ester-based solvent enhancers (not shown here). These do not show dark deposits but light color deposits which do not show as clearly the presence of deposits. Yet these deposits can be just as damaging to an operation.

According to embodiments, disclosed herein is the use of solvent enhancers to extend the operational efficiency and life of critical components e.g. bearings, heat exchanges of turbines, compressors, heat exchangers and hydraulic systems.

Figure 6:
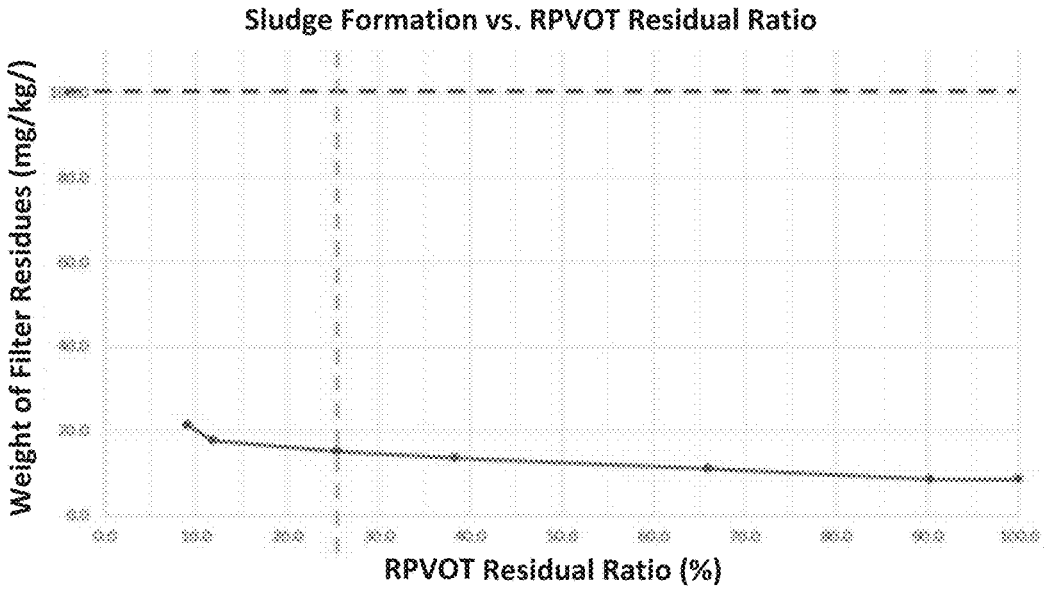
FIG. 6 is a chart showing that a fully formulated oil achieved a result of 15.2 mg of sludge at the end point of the test when the Rotating Pressure Vessel Oxidation Test (RPVOT) reached 25% of the initial oxygen pressure.

The use of Guerbet alcohols as described in 00073 can result in longer operational campaigns by keeping in solution oxidation byproducts and thus preventing the formation of deposits, varnish or sludges. An example of this is shown in FIG. 6. Where a fully formulated oil containing between 2-5% Guerbet alcohols has been shown to vastly exceed the specifications required in the accelerated oxidation test known as the Dry TOST Method (ASTM D7873-13 (2017)—Standard Test Method for Determination of Oxidation Stability and Insolubles Formation of Inhibited Turbine Oils at 120° C. Without the Inclusion of Water). The fully formulated oil achieved a result of 15.2 mg of sludge at the end point of the test when the RPVOT reached 25%. This value is significantly below the common passing requirement of 100 mg of sludge.

Figure 8:
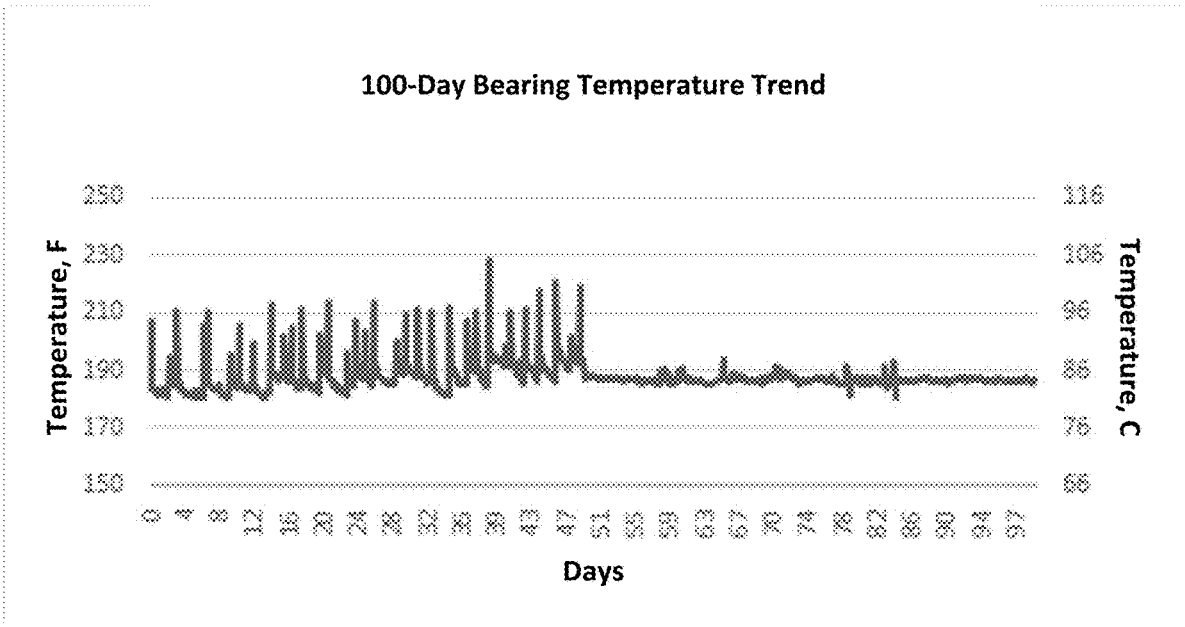
FIG. 8 is a chart showing the treatment of a compressor oil with a tank side additive containing Guerbet alcohol (day 50).

Furthermore, according to various embodiments, disclosed herein is the use of Guerbet alcohols as solvent enhancers can reduce working temperatures of bearings. This reduction in turn can result in the life extension of bearings. This is demonstrated in FIG. 8. It shows a 100-day temperature trend of the compressor bearing temperature where the solubility enhancing agent was added at Day 50. The deposit derived bearing temperature excursions (surface temperature) were threatening reliable machine operation. Upon tank-side addition of a solubility enhancer containing 3% Guerbet alcohols to the in-service compressor oil, the bearing temperature excursions stopped, and the temperature dropped by 33 F (18 C). This is attributed to the solvent enhancer maintaining the free flow of lubricant to cool the bearing. This occurs due to the dissolving of deposits that restrict flow and thus hinder the cooling effect of the lubricant. The removal of deposits also reduces the insulating effect of varnish deposits that lead to higher temperatures in bearing surfaces and to less efficient heat exchange of heat exchanger elements.

What is claimed is:

1. A method comprising:

adding an effective amount of a solvency enhancer to an oil composition, wherein the solvency enhancer comprises:

two or more alcohols, the two or more alcohols comprising at least one branched or dimerized Guerbet alcohol with 24-26 carbon atoms and 16-methylheptadecanol, wherein the two or more alcohols are in an amount of about 40 wt % to about 79 wt % based on the total weight of the solvency enhancer, at least one adipate ester in an amount of about 1 wt % to about 10 wt % based on the total weight of the solvency enhancer, and a base oil in an amount of about 20 wt % to about 50 wt % based on the total weight of the solvency enhancer, wherein the base oil comprises an Group I base oil, a Group II base oil, or a combination thereof; and at least one of dissolving byproducts in the oil composition, dissolving organic deposits in a system comprising the oil composition, preventing sludge in the oil composition and preventing varnish formation in the oil composition.

2. The method of claim 1, wherein the oil composition comprises at least one of a lubricating oil, a heat transfer fluid and a hydraulic oil.

3. The method of claim 2, wherein the lubricating oil comprises at least one of a turbine oil, a refrigerant oil and a gear oil.

4. The method of claim 2, wherein the hydraulic oil comprises at least one of a non-aqueous mineral oil and a synthetic oil.

5. The method of claim 1, wherein the oil composition comprises at least one of a mineral formulation and a synthetic formulation.

6. The method of claim 1, wherein the byproducts comprise at least one of an antioxidant degradation compound and an oil-derived degradation compound, and wherein the organic deposits comprise agglomerated degradation byproducts of base oils, antioxidants, or other additives, wherein the other additives comprise defoamants and co-solubilizers.

7. The method of claim 1, wherein the at least one Guerbet alcohol has about 12 to about 32 carbon atoms.

8. The method of claim 1, wherein the at least one Guerbet alcohol has a Noack volatility (ASTM D5800) of about 10 wt % to about 18 wt % of the oil composition.

9. The method of claim 1, wherein the at least one Guerbet alcohol has a Hansen solubility parameter comprising a dispersion (D) parameter of about 15 to about 18, a polar (P) parameter of about 3.5 to about 5.5, and a hydrogen bonding (H) parameter of about 8 to about 12.

10. The method of claim 1, wherein the at least one Guerbet alcohol has an interfacial surface energy of about 25 mN/m to about 35 mN/m.

11. The method of claim 1, wherein the oil composition further comprises a Group III base oil, a Group IV base oil, a Group V base oil, or a combination of any two or more thereof.

12. The method of claim 1, further comprising forming a working mixture, wherein the working mixture comprises a lubricant oil, a degradation byproduct, the solvency enhancer comprising the at least one Guerbet alcohol, solvency enhancer degradation byproducts or a combination of any two or more thereof.

13. The method of claim 12, wherein the at least one Guerbet alcohol in the working mixture is in an amount of greater than 1.0 vol % to about 30 vol % relative to the total volume of the working mixture.

14. A solvency enhancer composition for a lubricating oil, the solvency enhancer composition comprising:

a first branched or dimerized Guerbet alcohol comprising 24 carbon atoms;

a second branched or dimerized Guerbet alcohol comprising 25 carbon atoms;

a third branched or dimerized Guerbet alcohol comprising 26 carbon atoms; and 16-methylheptadecanol.

15. The solvency enhancer composition of claim 14, comprising about 20 vol % to about 50 vol % of the 16-methylheptadecanol based on the total volume of the solvency enhancer composition.

16. A lubricating oil composition, comprising:

a solvency enhancer comprising:

a first branched or dimerized Guerbet alcohol comprising 24 carbon atoms, a second branched or dimerized Guerbet alcohol comprising 25 carbon atoms, a third branched or dimerized Guerbet alcohol comprising 26 carbon atoms, 16-methylheptadecanol, at least one adipate ester in an amount of greater than 0 vol % to about 5 vol % based on the total weight of the lubricating oil composition, and a base oil in an amount of about 30 vol % to about 70 vol % based on the total weight of the lubricating oil composition, wherein the base oil comprises a Group I base oil, a Group II base oil, or a combination thereof; and a lubricating oil.

17. A method of maintaining dissolution of byproducts in an in-service lubricant oil, comprising:

flowing, storing or both the in-service lubricant oil in operating equipment, wherein the in-service lubricant oil comprises an effective amount of a solvency enhancer and is subject to oxidation, thermal degradation, hydrolysis, or a combination of two or more thereof, wherein the solvency enhancer comprises:

two or more alcohols, the two or more alcohols comprising at least one Guerbet alcohol with 24-26 carbon atoms and 16-methylheptadecanol, wherein the two or more alcohols are in an amount of about 40 wt % to about 100 wt % based on the total weight of the solvency enhancer; and dissolving byproducts in the in-service lubricant oil, dissolving organic deposits in the operating equipment, preventing sludge in the in-service lubricant oil, preventing varnish formation in the in-service lubricant oil, or a combination of any two or more thereof.

18. The method of claim 17, wherein the in-service lubricant oil comprises a turbine oil, a heat transfer fluid, a refrigerant oil, a non-aqueous mineral oil, a synthetic oil, or a combination thereof.

19. The method of claim 17, wherein the byproducts comprise an antioxidant degradation compound, an oil-derived degradation compound or a combination thereof, and wherein the organic deposits comprise agglomerated degradation byproducts of base oils, antioxidants, or other additives, wherein the other additives comprise defoamants and co-solubilizers.

20. The method of claim 17, wherein the at least one Guerbet alcohol has about 12 to about 32 carbon atoms.

21. The method of claim 17, wherein the at least one Guerbet alcohol has a Noack volatility (ASTM D5800) of about 10 wt % to about 18 wt % of the oil composition.

22. The method of claim 17, wherein the at least one Guerbet alcohol has a Hansen solubility parameter comprising a dispersion (D) parameter of about 15 to about 18, a polar (P) parameter of about 3.5 to about 5.5, and a hydrogen bonding (H) parameter of about 8 to about 12.

23. The method of claim 17, wherein the at least one Guerbet alcohol has an interfacial surface energy of about 25 mN/m to about 35 mN/m.

24. The method of claim 17, wherein the in-service lubricant oil comprises a Group III base oil, a Group IV base oil, a Group V base oil, or a combination of any two or more thereof.

25. The solvency enhancer composition of claim 14, further comprising:

at least one adipate ester in an amount of about 1 wt % to about 10 wt % based on the total weight of the solvency enhancer, and a base oil in an amount of about 20 wt % to about 50 wt % based on the total weight of the solvency enhancer, wherein the base oil comprises a Group I base oil, a Group II base oil, or a combination thereof.

* * * * *